US006539198B2

(12) United States Patent
Miyajima

(10) Patent No.: US 6,539,198 B2
(45) Date of Patent: Mar. 25, 2003

(54) IMAGE FORMING APPARATUS, CONTROL METHOD OF THE IMAGE FORMING APPARATUS AND STORAGE MEDIUM

(75) Inventor: Jun Miyajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/905,878

(22) Filed: Jul. 17, 2001

(65) Prior Publication Data

US 2002/0018679 A1 Feb. 14, 2002

(30) Foreign Application Priority Data

Jul. 19, 2000 (JP) ..... 2000-219117

(51) Int. Cl.[7] ..... G03G 15/00
(52) U.S. Cl. ..... 399/389; 399/401
(58) Field of Search ..... 399/45, 388, 389, 399/397, 401

(56) References Cited

U.S. PATENT DOCUMENTS 4,935,786 A * 6/1990 Veeder ..... 399/401
5,703,693 A * 12/1997 Morikawa ..... 399/389 X
5,893,020 A * 4/1999 Atsumi ..... 399/401 X

FOREIGN PATENT DOCUMENTS

JP 9-278252 10/1997
JP 9-315699 12/1997

* cited by examiner

*Primary Examiner*—Sandra Brase
(74) *Attorney, Agent, or Firm*—Fitzpatrick, Cella, Harper & Scinto

(57) ABSTRACT

An image forming apparatus including an image forming portion for forming an image on a sheet fed from a sheet loading portion, a re-feeding path for re-feeding a sheet on which an image is formed by the image forming portion, a first discriminating portion for discriminating a type of a sheet, a second discriminating portion for discriminating a size of a sheet, and a control unit for circulating sheets of the number according to the type of the sheet discriminated by the first discriminating portion and the size of the sheet discriminated by the second discriminating portion in the re-feeding path. When circulating cardboard of an A4R size or a letter R size in the re-feeding path, the control unit circulates sheets of the number fewer than the number of sheets at the time when a plain paper or a recycled paper is circulated in the re-feeding path.

18 Claims, 18 Drawing Sheets

FIG. 15

| SHEET SIZE | PAPER TYPE | MAIN SCANNING DIRECTION (WIDTH) | SUB-SCANNING DIRECTION (LENGTH) | NUMBER OF CIRCULATING SHEETS |
|---|---|---|---|---|
| A3 | PLAIN PAPER | 297mm | 420mm | 3 |
| A3 | RECYCLED PAPER | 297mm | 420mm | 3 |
| A3 | CARDBOARD | 297mm | 420mm | 3 |
| A3 | OHP | 297mm | 420mm | × |
| A4 | PLAIN PAPER | 297mm | 210mm | 5 |
| A4 | RECYCLED PAPER | 297mm | 210mm | 5 |
| A4 | CARDBOARD | 297mm | 210mm | 5 |
| A4 | OHP | 297mm | 210mm | × |
| A4R | PLAIN PAPER | 210mm | 297mm | 5 |
| A4R | RECYCLED PAPER | 210mm | 297mm | 5 |
| A4R | CARDBOARD | 210mm | 297mm | 3 |
| A4R | OHP | 210mm | 297mm | × |
| LEDGER | PLAIN PAPER | 279.4mm | 431.8mm | 3 |
| LEDGER | RECYCLED PAPER | 279.4mm | 431.8mm | 3 |
| LEDGER | CARDBOARD | 279.4mm | 431.8mm | 3 |
| LEDGER | OHP | 279.4mm | 431.8mm | × |
| LETTER | PLAIN PAPER | 279.4mm | 215.9mm | 5 |
| LETTER | RECYCLED PAPER | 279.4mm | 215.9mm | 5 |
| LETTER | CARDBOARD | 279.4mm | 215.9mm | 5 |
| LETTER | OHP | 279.4mm | 215.9mm | × |
| LETTER R | PLAIN PAPER | 215.9mm | 279.4mm | 5 |
| LETTER R | RECYCLED PAPER | 215.9mm | 279.4mm | 5 |
| LETTER R | CARDBOARD | 215.9mm | 279.4mm | 3 |
| LETTER R | OHP | 215.9mm | 279.4mm | × |
| ⋮ | ⋮ | ⋮ | ⋮ | ⋮ |

FIG. 19

| DIRECTORY INFORMATION |
| --- |
| FIRST DATA PROCESSING PROGRAM<br>GROUP OF PROGRAM CODES CORRESPONDING TO STEPS OF FLOW CHART SHOWN IN FIG.14 |
| |

MEMORY MAP OF STORAGE MEDIUM

IMAGE FORMING APPARATUS, CONTROL METHOD OF THE IMAGE FORMING APPARATUS AND STORAGE MEDIUM

BACKGROUND OF THE INVENTION

1. Field of the Invention

The present invention relates to an image forming apparatus including an image forming portion for forming an image on a sheet fed from a sheet loading portion and a re-feeding path for re-feeding the sheet, on which an image has been formed by the image forming portion, to the image forming portion.

2. Related Background Art

Conventionally, as a method of forming images on both sides of a multiplicity of recording sheets, there is a method of utilizing a circulating type sheet transporting process (what is called a tray-less both side mechanism or a through-pass both side mechanism). With this circulating type sheet transporting process, a recording sheet is sent to a transfer portion for transferring an image, then, the recording sheet having an image transferred on one side is sent to a reversing portion, the recording sheet reversed in the reversing portion is sent again (re-fed) to the transfer portion without being gathered in a tray for exclusively containing sheets to be printed on both sides, and the image is transferred on the opposite side.

The both side image forming method employing this process has advantages compared with a both side image forming method, with which a recording sheet having an image formed on one side is revered, all of reversed sheets are gathered in a tray for exclusively containing sheets to be printed on both sides, the gathered sheet is sent again to a transfer portion to thereby form an image on the other side (what is called a stack type both side mechanism). That is, the speed for forming an image is improved, unnecessary increase of costs due to installation of the tray for exclusively containing sheets to be printed on both sides or the like and a limitation on the number of loaded sheets in the tray for exclusively containing sheets to be printed on both sides are not caused.

As an image forming apparatus employing such a circulating type sheet transporting process, there is an apparatus disclosed, for example, in Japanese Patent Application Laid-open No. 9-315699. The disclosed image forming apparatus performs such control that, if the number of sheets on the both sides of which an image should be formed exceeds the number of sheets circulating in the apparatus, sheets are fed firstly in the number of "(number of circulating sheets+1)/2" (i.e., in the case of three sheets circulating type image formation, (3+1)/2=2, in the case of five sheets circulating type image formation, (5+1)/2=3, and in the case of seven sheets circulating type image formation, (7+1)/2=4), and then, sheet feeding and sheet re-feeding are alternately repeated, whereby images can be formed at the same interval for feeding sheets as in one side image formation.

In addition, as a method of preventing a jam by executing transportation control according to a type of a sheet, there is a method disclosed, for example, in Japanese Patent Application Laid-open No. 9-278252. With the disclosed method, a paper type sensor is provided in an image forming apparatus, which determines a paper type and causes the image forming apparatus not to apply straight paper discharge or both side printing to sheets such as cardboard and an OHP sheet.

FIGS. 20A to 20C are schematic illustrations showing timings for feeding sheets according to different numbers of circulating sheets in an identical path length in an image forming apparatus of this type.

Further, a frame of solid lines not hatched indicates feeding of a front side of a recording sheet in both side image formation or feeding of a recording sheet in one side image formation. In addition, a hatched frame of solid lines indicates re-feeding of a back side of a recording sheet in the both side image formation. A frame of broken lines indicates that there is a space equivalent to one sheet between sheets.

In addition, in the figure, numerals 1 to 5 written on recording sheets indicate how many sheets have been fed.

In the figures, FIG. 20A corresponds to circulation of three sheets of a large sheet size (e.g., A3 size), FIG. 20B corresponds to circulation of three sheets of a small sheet size (e.g., A4 size), and FIG. 20C corresponds to circulation of five sheets of a small sheet size (e.g., A4 size).

As shown in the figure, when a length of sheet path 19001 is fixed, if three sheets circulating type image formation is performed in the case of sheets of a large size as shown in FIG. 20A, and if five sheets circulating type image formation is performed in the case of sheets of a small size as shown in FIG. 20C, images can be formed efficiently with only a few spaces between sheets. However, in the case of sheets of a small size with the identical sheet path length 19001 as shown in FIG. 20B, if the three sheets circulating type image formation is performed, there are many spaces between sheets and images cannot be formed efficiently.

In the above-mentioned conventional process, the number of circulating sheets peculiar to an image forming apparatus is fixed. Thus, there is a problem in that, if an image forming apparatus capable of circulating three sheets of a large size to form images as shown in FIG. 20A performs a circulating operation with sheets of a small size as shown in FIG. 20B, there are many space between sheets, and a throughput decreases.

In addition, in recent years, the both side printing can also be performed in an image forming apparatus, which prohibited reverse discharge and both side printing of cardboard before. However, there is also a problem in that, if the number of circulating sheets is fixed depending on an apparatus or if the number of circulating sheets is made determinable according to a sheet size in order to overcome the above-mentioned problem, there is a possibility that a transporting speed of sheets is slowed down and a jam occurs due to shortage of torque of a transporting motor depending on a type of a sheet such as cardboard when the number of circulating sheets is identical with that of plain paper.

SUMMARY OF THE INVENTION

The present invention has been devised in order to solve the above-mentioned problems. It is an object of the present invention to provide an image forming apparatus for forming images on both sides of a sheet by a circulating type sheet transporting process, a method of controlling the image forming apparatus and a storage medium for the image forming apparatus wherein a user interface capable of setting a type of a sheet is provided to perform both side image formation in which the number of circulating papers is variable according to not only a size of a sheet but also a type of a sheet at the time of the both side image formation by the circulating type sheet transporting method, whereby transportation control is performed according to a type of a sheet on which images are formed and occurrence of sheet curl and a jam due to the sheet curl can be prevented, a method of controlling the image forming apparatus and a storage medium for the image forming apparatus.

BRIEF DESCRIPTION OF THE DRAWINGS

FIG. 15 shows an example of a table for determining the number of circulating sheets according to a sheet size and a paper type (a table of the number of circulating sheets corresponding to a sheet size and a paper type) in the image forming apparatus of the present invention;

FIG. 19 illustrates a memory map of a storage medium storing various kinds of data processing programs,that can be read by the image forming apparatus in accordance with the present invention.

DESCRIPTION OF THE PREFERRED EMBODIMENTS

Figure 1:
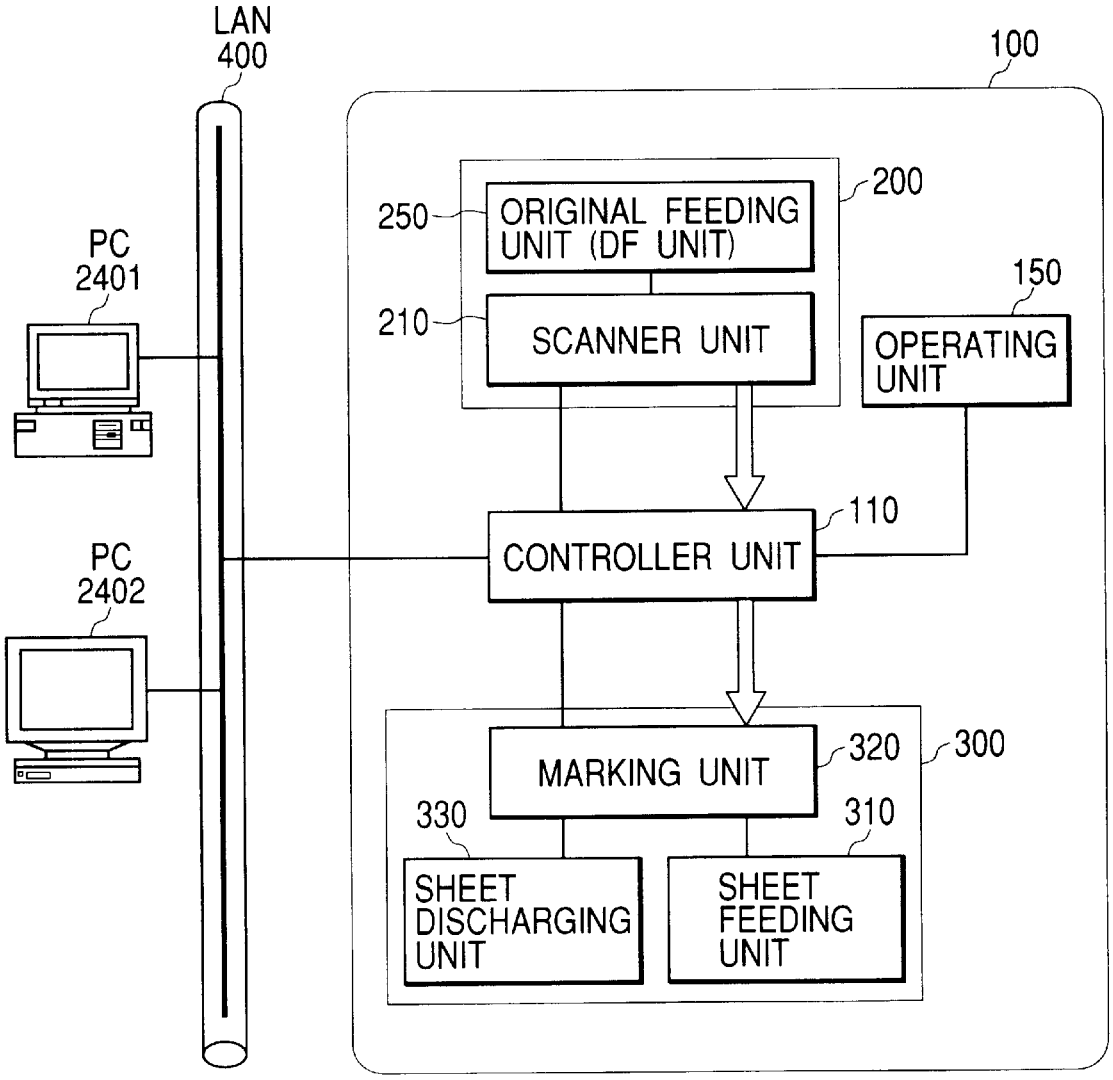
FIG. 1 illustrates an overall configuration of an image input/output system to which an image forming apparatus showing an embodiment of the present invention can be applied.

FIG. 1 illustrates an overall configuration of an image input/output system 100 to which an image forming apparatus showing an embodiment of the present invention can be applied.

In the figure, reference numeral 200 denotes a reader unit (reading device), which optically reads an image of an original and converts it into image data. The reader unit 200 is composed of a scanner unit 210 having a function for reading an original and an original sheet feeding unit (DF unit) 250 having a function for transporting a sheet of an original.

Reference numeral 300 denotes a printer unit (printing device), which transports a recording sheet and prints image data thereon as a visible image to discharge the recording sheet outside the device. The printer unit 300 is composed of a sheet feeding unit 310 having a plurality of kinds of recording sheet cassettes, a marking unit 320 having a function of transferring and fixing image data onto a recording sheet, and a sheet discharging unit 330 having a function of sorting or stapling printed recording sheets to output it outside the device.

Reference numeral 110 denotes a controller unit, which is electrically connected to the reader unit 200 and the printer unit 300 and is further connected to host computers 2401 and 2402 via a network 400 such as the Ethernet.

The controller unit 110 controls the reader unit 200 to read image data of an original and controls the printer unit 300 to output the image data to a recording sheet, thereby providing a copying function. The controller unit 110 also provides a scanner function for converting the image data read from the reader unit 200 into code data to transmit it to the host computers 2401 and 2402 via the network 400 and a printer function for converting received code data from the host computers 2401 and 2402 via the network 400 into image data to output it to the printer unit 300. Reference numeral 150 denotes an operating unit, which is connected to the controller unit 110, composed of a liquid crystal touch panel and provides a user I/F for operating the image input/output system.

Figure 2:
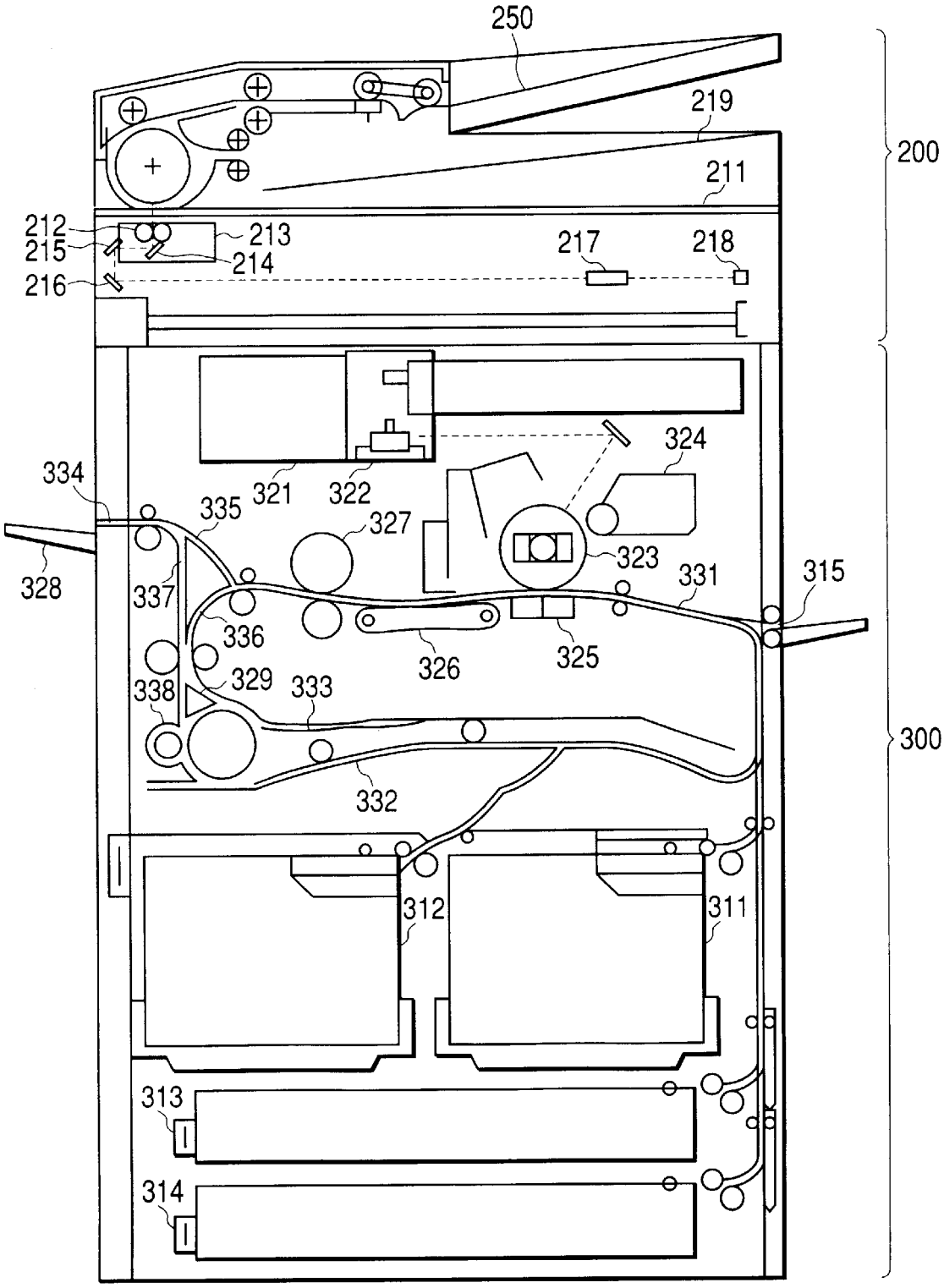
FIG. 2 is a sectional view illustrating a configuration of a reader unit and a printer unit shown in FIG. 1.

FIG. 2 is a sectional view illustrating a configuration of the reader unit 200 and the printer unit 300 shown in FIG. 1, in which parts identical with those in FIG. 1 are denoted by the identical reference numerals.

In the reader unit 200, the.original feeding unit 250 feeds originals onto a platen glass 211 one by one from the top one and discharges the original on the platen glass 211 to a discharge tray 219 after finishing an operation for reading the original. When the original is transported onto the platen glass 211, the reader unit 200 lights a lamp 212 and causes an optical unit 213 to start movement to expose and scan the original. Light reflected from the original at this point is guided to a CCD image sensor (hereinafter referred to as a CCD) 218 by mirrors 214, 215 and 216 and a lens 217. In this way, an image of a scanned original is read by the CCD 218. Image data outputted from the CCD 218 is subjected to a predetermined processing and then transferred to the controller unit 110.

In the printer unit 300, reference numeral 321 denotes a laser driver, which drives a laser beam emitting portion 322 and causes the laser beam emitting portion 322 to emit laser beam corresponding to image data outputted from the controller unit 110. This laser beam is irradiated on a photosensitive drum 323, and a latent image corresponding to the laser beam is formed on the photosensitive drum 323. A developer is deposited on a part of the latent image on the photosensitive drum 323 by a developing unit 324.

Then, at the timing in synchronous with the start of the laser beam irradiation, a recording medium (a recording medium, a recording sheet, a sheet and paper are hereinafter used to indicate the same meaning) is fed from any one of cassettes 311, 312, 313 and 314 and a hand supply sheet feeding shelf 315 and guided to a transfer portion 325 through a transporting path 331, where the developer deposited on the photosensitive drum 323 is transferred to the recording sheet. The recording sheet having the developer thereon is transported to a fixing portion 327 by a transporting belt 326, and the developer is fixed on the recording sheet by heat and pressure of the fixing portion 327.

Thereafter, the recording sheet having passed the fixing portion 327 passes through transporting paths 335 and 334 and is discharged in a discharge bin 328. Alternatively, if a printing side of the recording sheet is reversed and the recording sheet is discharged in the discharge bin 328, the recording sheet is guided to transporting paths 336 and 338 and then transported to the opposite direction to pass through transporting paths 337 and 334.

In addition, if both side recording is set, the recording sheet is guided to a transporting path 333 from the transporting path 336 by a flapper 329 after passing through the fixing portion 327. The recording sheet is thereafter transported in the opposite direction and guided to the transporting path 338 and a re-fed sheet transporting path 332 by the flapper 329. The recording sheet guided to the re-fed sheet transporting path 332 passes through the transporting path 331 at the above-mentioned timing to be fed to the transfer portion 325.

Description of the Control Device

Figure 3:
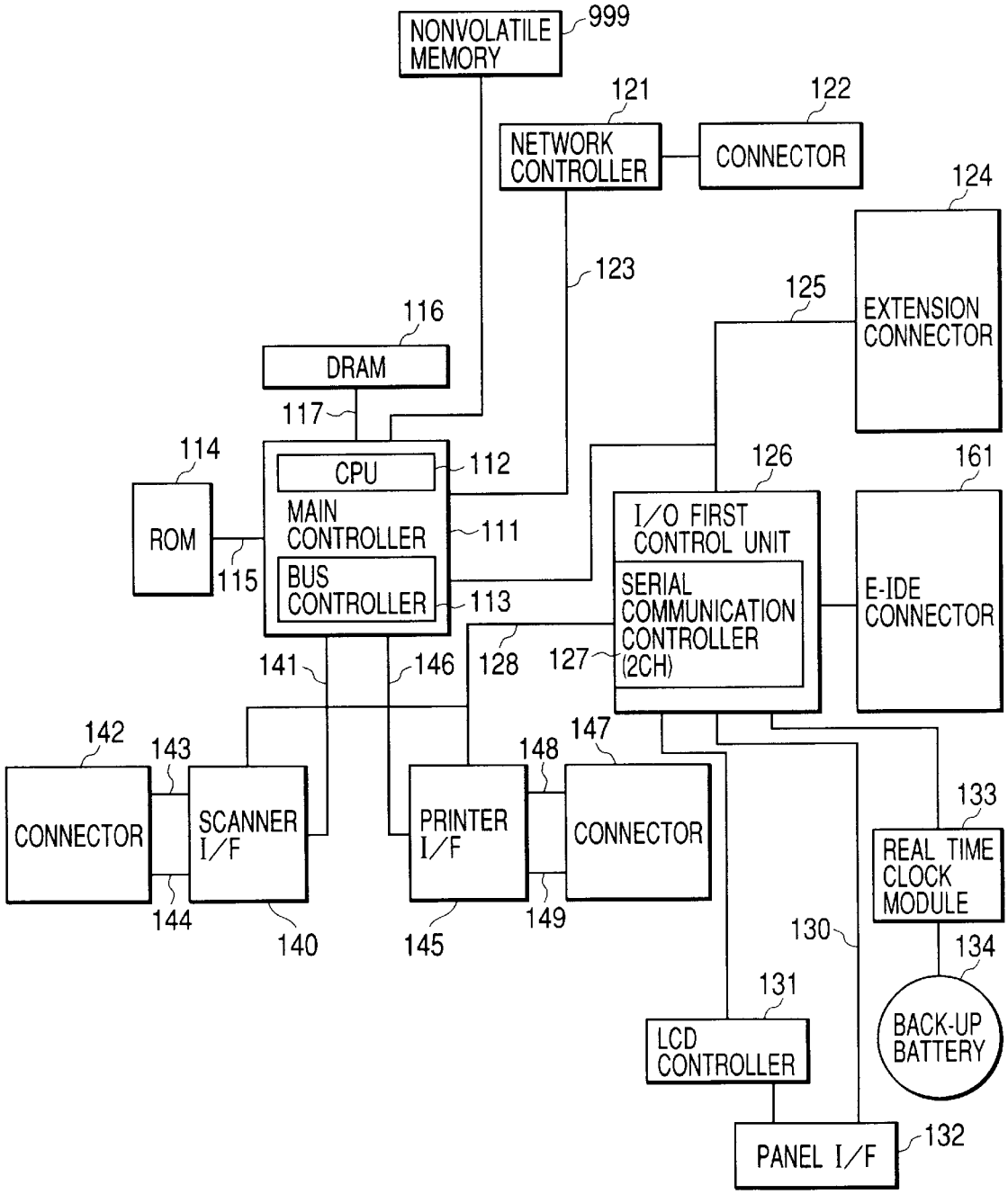
FIG. 3 is a block diagram illustrating a functional configuration of a controller unit device shown in FIG. 1.

FIG. 3 is a block diagram illustrating a functional configuration of the controller unit 110 shown in FIG. 1, in which parts identical with those in FIG. 1 are denoted by the identical reference numerals.

In the figure, reference numeral 111 denotes a main controller, which is mainly composed of a CPU 112, a bus controller 113 and various kinds of I/F controller paths.

The CPU 112 and the bus controller 113 control an operation of the entire controller unit 110. The CPU 112 operates based on a program read from an ROM 114 through an ROM I/F 115. In addition, operations for interpreting PDL (page description language) code data received from the host computers 2401 and 2402 and extending it to raster image data are also described in this program and processed by software. The bus controller 113 controls transfer of data inputted or outputted from each I/F, and controls adjustment at the time of bus contention and transfer of DMA data.

Reference numeral 116 denotes a DRAM, which is connected to the main controller 111 by a DRAM I/F 117 and used as a work area for the CPU 112 to operate or an area for accumulating image data.

Reference numeral 999 denotes a nonvolatile memory (NVRAM or the like), which stores a recording medium type (a recording medium type and a paper type are hereinafter used to indicate the same meaning) or the like to be set for each sheet feeding shelf from the operating unit 150.

Reference numeral 121 denotes a network controller, which is connected to the main controller 111 by an I/F 123 and connected to an external network (LAN 400) by a connector 122. A network is generally represented by the Ethernet but may be the Token Ring or other networks.

Reference numeral 125 denotes a general-purpose high-speed bus, to which an extension connector 124 for connecting an extension board and an I/O control portion 126 are connected. The general-purpose high-speed bus is generally represented by a PCI bus but may be an ISA bus or other buses.

The I/O control unit 126 is provided with two channels of a start-stop synchronous serial communication controller 127 for transmitting and receiving control commands to and from each CPU in the reader unit 200 and the printer unit 300. The I/O control unit 126 is connected to external I/F paths (a scanner I/F 140 and a printer I/F 145) by an I/O bus 128.

Reference numeral 132 denotes a panel I/F, which is connected to an LCD controller 131 and composed of an I/F for displaying an image on a liquid crystal screen on the operating unit 150 and a key input I/F 130 for inputting hard keys or touch panel keys.

The operating unit 150 includes a liquid crystal display unit, a touch panel input device attached on the liquid crystal display unit and a plurality of hard keys. Signals inputted by the touch panel or the hard keys are communicated to the CPU 112 via the above-mentioned panel I/F 132. The liquid crystal display unit displays image data sent from the panel I/F 132. Functions in operating the image forming apparatus, image data and the like are displayed on the liquid crystal display unit.

Reference numeral 133 is a real time clock module, which updates and/or saves date and time managed in the apparatus and is backed up by a backup battery 134. Reference numeral 161 denotes an E-IDE connector, which connects an external storage device to the apparatus. A hard disk or a CD-ROM drive is connected to the apparatus via this I/F, whereby a program or image data can be written or read.

Reference numerals 142 and 147 denote connectors, which are connected to the reader unit 200 and the printer unit 300, respectively, and are composed of start-stop synchronous serial I/Fs (143, 148) and video I/Fs (144, 149).

Reference numeral 140 denotes a scanner I/F, which is connected to the reader unit 200 via the connector 142 and connected to the main controller 111 by a scanner bus 141. The scanner I/F 140 has a function of applying optimal binarization or magnification processing of main scanning and sub-scanning to an image received from the reader unit 200, to be congruous to processing to be performed in the subsequent procedure. The scanner I/F 140 further has a function of outputting a control signal, which is generated based on a video control signal sent from the reader unit 200, to the scanner bus 141.

Further, data transfer from the scanner bus 141 to the DRAM 116 is controlled by the bus controller 113.

The printer I/F 145 is connected to the printer unit 300 via the connecter 147 and connected to the main controller 111 by the printer bus 146. The printer I/F 145 has a function of applying smoothing processing to image data outputted from the main controller 111 and outputting the image data to the printer unit 300. The printer I/F 145 further has a function of outputting a control signal, which is generated based on a video control signal sent from the printer unit 300, to the printer bus 146.

Transfer of raster image data extended on the DRAM 116 to the printer unit 300 is controlled by the bus controller 113 and the raster image is transferred by means of DMA to the printer unit 300 through the printer bus 146 and the video I/F 149.

Description of the Main Controller

Figure 4:
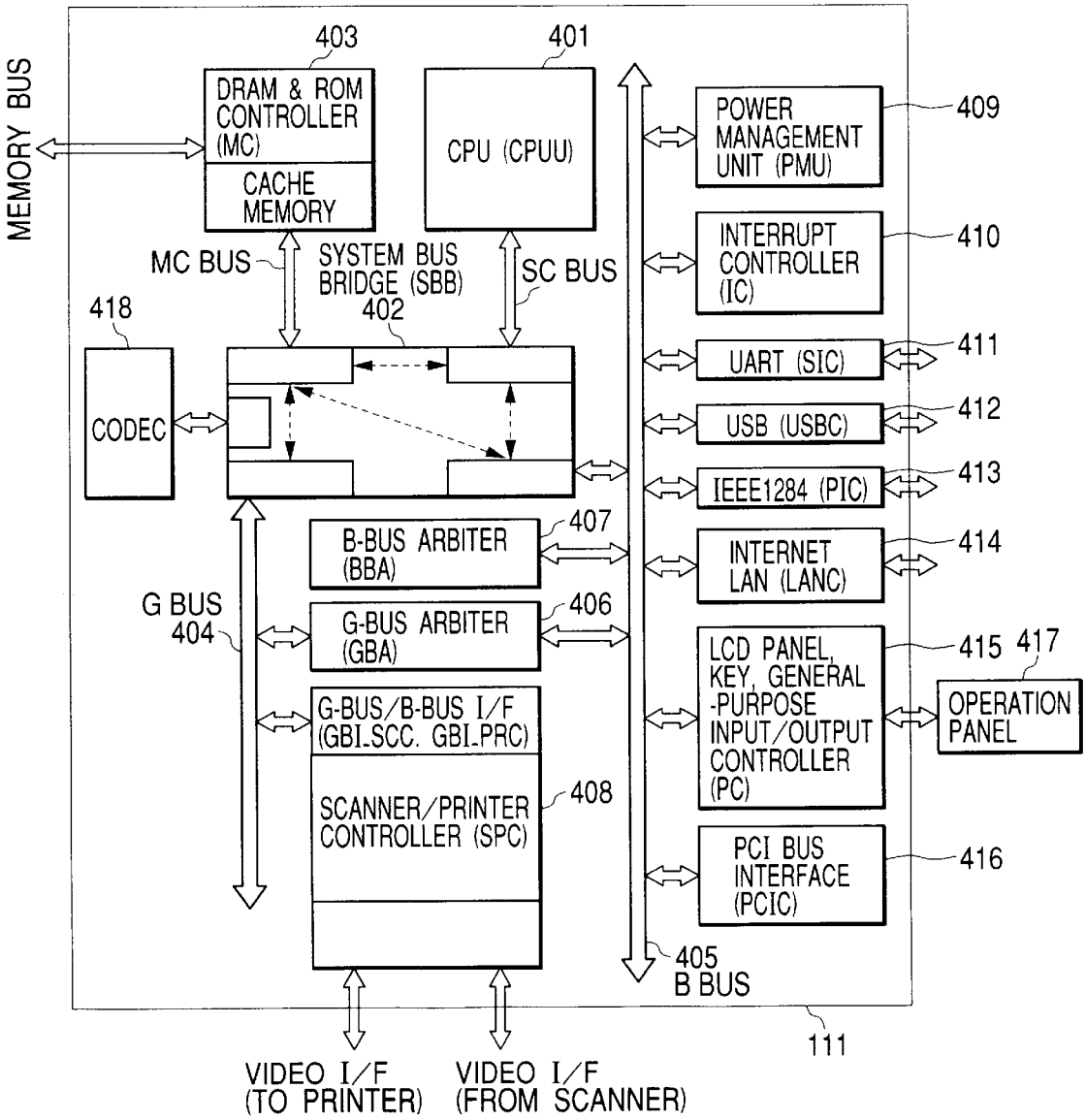
FIG. 4 is a block diagram illustrating a configuration of a main controller shown in FIG. 3.

FIG. 4 is a block diagram showing a configuration of the main controller 111 shown in FIG. 3.

In the figure, a processor core (CPU) 401 (equivalent to the CPU 112 shown in FIG. 3) is connected to a system bus bridge (SBB) 402 via a 64 bit processor bus (SC bus).

Further, the system bus bridge (SBB) 402 (including a G bus arbiter (GBA) 406 and a B bus arbiter (BBA) 407) is equivalent to the bus controller 113 shown in FIG. 3.

The SBB 402 is a 4×4 64 bit crossbar switch, which is connected to a memory controller 403 for controlling an SDRAN or an ROM provided with a cache memory by a dedicated local bus (MC bus (MCBus)) in addition to the processor core 401. Moreover, the SBB 402 is connected to a G bus (Gbus) 404 being a graphic bus and a B bus (Bbus) 405 being an IO bus. Therefore, the SBB 402 is connected to the total four buses.

The SBB 402 is designed to secure simultaneous parallel connection among these four modules as much as possible. In addition, the SBB 402 is connected to a unit for compressing and extending data (CODEC) 418 via a codec I/F.

The G bus 404 is coordinately controlled by the G bus arbiter (GBA) 406 and connected to a scanner/printer controller (SPC) 408 for connecting it to a scanner (reader unit 200) or a printer (printer unit 300).

In addition, the B bus 405 is coordinately controlled by the B bus arbiter (BBA) 407 and is also connected to a power managing unit (PMU) 409, an interrupt controller (IC) 410, a serial interface controller (SIC) 411 using the UART, a USB controller 412, a parallel interface controller (PIC) 413 using the IEEE1284, an LAN controller (LANC) 414 using the Ethernet, an LCD panel, keys, a general-purpose input/output controller (PC) 415 and a PCI bus interface (PCIC) 416 in addition to the SPC 408.

A operating panel 417 provided with a display panel or a keyboard is connected to the PC 415.

Description of the Interrupt Controller (IC)

The interrupt controller (IC) 410 is connected to the B bus 405. The interrupt controller 410 integrates interrupts from each function block in a main controller chip and from the outside of the chip, and re-distributes the interrupts to six-level external interrupts and non-maskable interrupts (NMI) supported by the CPU 401. Further, the above-mentioned each function block means the power management unit 409, the serial interface controller 411, the USB controller 412, the parallel interface controller 413, the Ethernet controller 414, the general-purpose IO controller 415, the PCI interface controller 416, the scanner/printer controller 408 or the like.

Description of the Memory Controller (MC)

The memory controller (MC) 403 is connected to an MC bus being a local bus used exclusively for a memory controller and controls a synchronous DRAM (SDRAM), a flash ROM or a ROM (equivalent to the DRAM 116 or the ROM 114 shown in FIG. 3).

Description of the System Bus Bridge (SBB)

Figure 5:
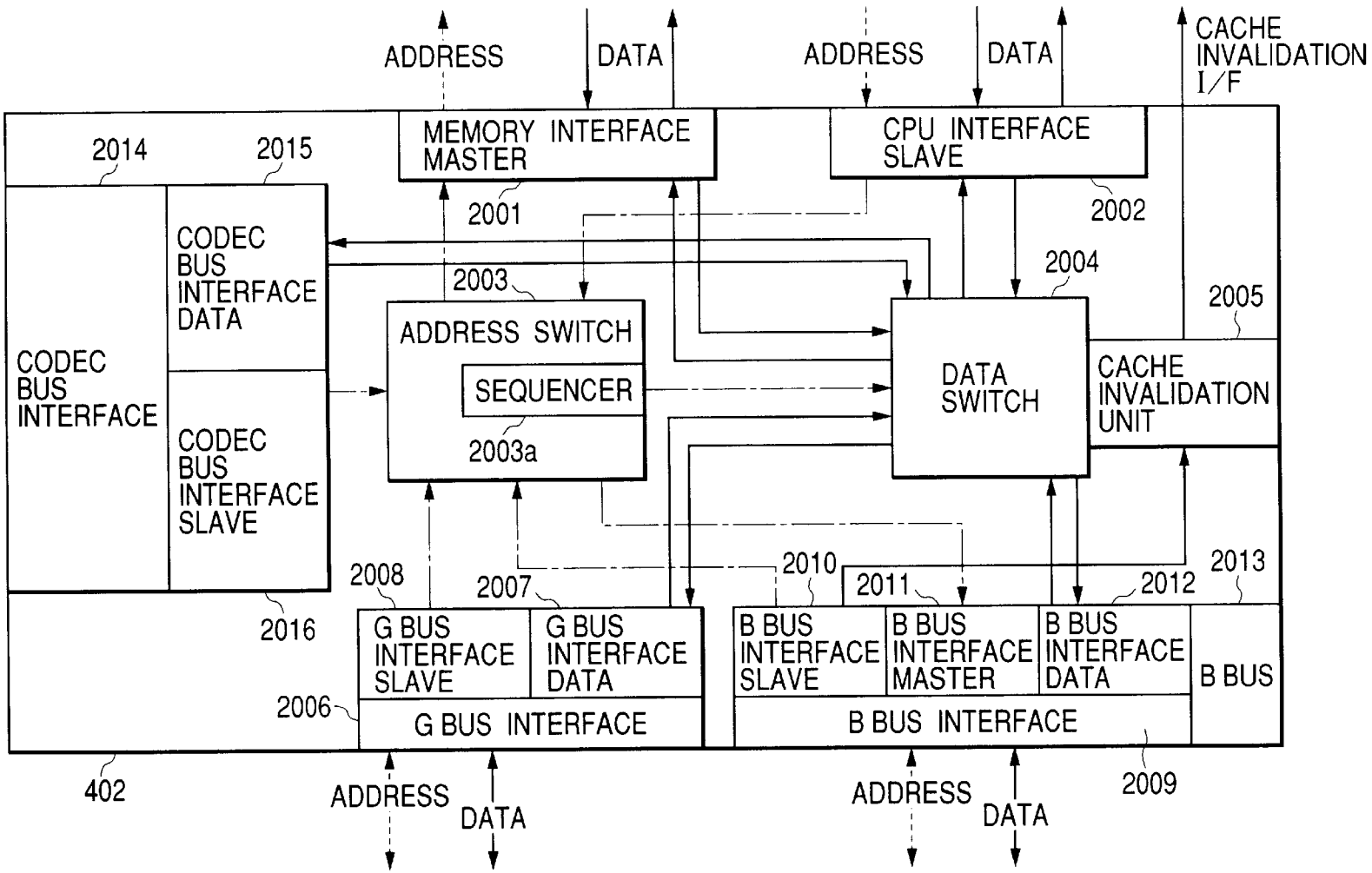
FIG. 5 is a block diagram illustrating a configuration of a system bus bridge (SBB) shown in FIG. 4.

FIG. 5 is a block diagram illustrating a configuration of the system bus bridge (SBB) 402 shown in FIG. 4.

The SBB 402 is a multi-channel bidirectional bus bridge, which provides mutual connection among a B bus (input/output bus), a G bus (graphic bus), an SC bus (processor local bus) and an MC bus using a crossbar switch. With the crossbar switch, two-way connections can be simultaneously established and high-speed data transfer with high parallelism can be realized.

As shown in the figure, the SBB 402 is provided with a B bus interface 2009 for connecting it to the B bus 405, a G bus interface 2006 for connecting it to the G bus, a CPU interface slave port 2002 for connecting it to the processor core 401, a memory interface master port 2001 for connecting it to the memory controller 403 and a CODEC bus interface 2014 for connecting it to the compression and extension unit 418. The SBB 402 further includes an address switch 2003 (provided with a sequencer 2003*a*) for connecting an address bus to it and a data switch 2004 for connecting a data bus to it. In addition, the SBB 402 is provided with a cache invalidation unit 2005 for invalidating a cache memory of a processor core.

In addition, the G bus interface 2006 is connected to the address switch 2003 via a G bus interface slave 2008 and connected to the data switch 2004 via a G bus interface data 2007. The CODEC bus interface 2014 is connected to the address switch 2003 via a COCEC bus interface slave 2016 and connected to the data switch 2004 via a COCEC bus interface data 2015. The B bus interface 2009 is connected to the address switch 2003 via a B bus interface slave 2010 and a B bus interface master 2011, connected to the cache invalidation unit 2005 via a B bus interface slave 2010 and connected to the data switch 2004 via a B bus interface data 2012.

Description of the PCI Bus Interface (PCIC)

The PCI bus interface (PCIC) 416 shown in FIG. 4 is a block for interfacing a B bus being a general-purpose IO bus inside a main controller and a PCI bus being an IO bus outside a chip.

Description of the G Bus Arbiter (GBA) and the B Bus Arbiter (BBA)

Arbitration of the G bus shown in FIG. 4 is performed in a central arbitration method, which has a request signal and a grant signal exclusive for each bus master. A control method can be programmed in this arbiter.

In addition, as a method of giving a priority to a bus master, either a fair arbitration mode for giving a bus right fairly assuming that all bus masters have the same priority or a preferential arbitration mode for giving a higher priority to any one of the bus masters to allow the bus master to use the bus preferentially can be designated.

The B bus arbiter (BBA) 407 shown in FIG. 4 receives a request to use the B bus 405 being an IO general-purpose bus, gives a use permission to a selected one master after arbitration and prohibits two or more masters from accessing the bus simultaneously. An arbitration method has three levels of priorities, and a plurality of masters can be programmably assigned to each priority.

Scanner Controller/Printer Controller (SPC)

Figure 6:
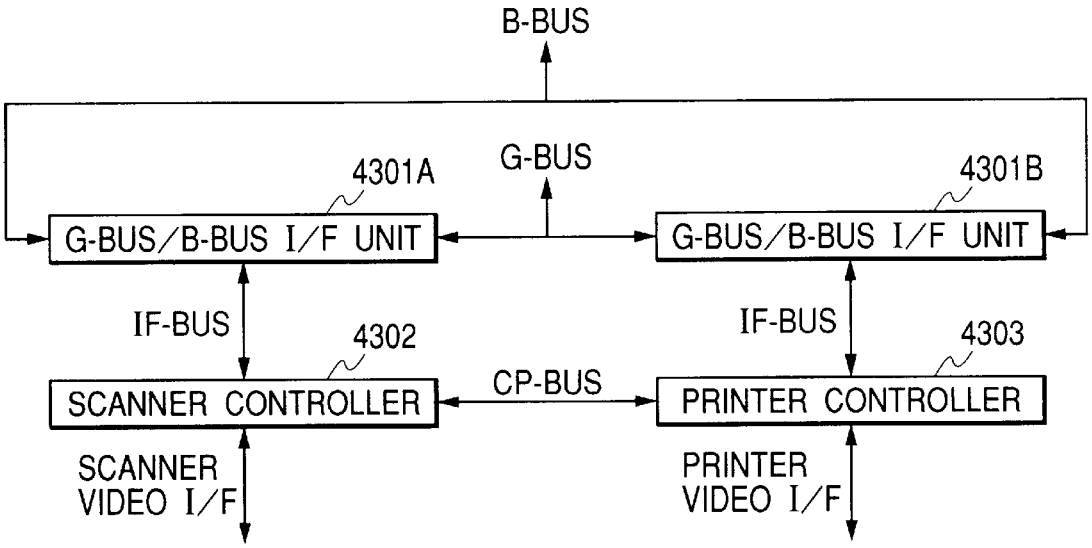
FIG. 6 is a block diagram illustrating a configuration of a scanner printer controller (SPC) shown in FIG. 4.

FIG. 6 is a block diagram illustrating a configuration of the scanner/printer controller (SPC) 408 shown in FIG. 4.

As shown in the figure, the scanner/printer controller (SPC) 408 is a block that is connected to a scanner (reader unit 200) and a printer (printer unit 300) by a video I/F and interfaces internal buses, the G bus 404 and the B bus 405. The scanner/printer controller 408 is roughly composed of the following three blocks.

(1) Reference numeral 4302 denotes a scanner controller, which is connected to the scanner with the video I/F and controls operations of the scanner and data transfer. The scanner controller 4302 is connected to a G bus/B bus I/F unit (GBI) 4301A by an IF bus. Data transfer and reading/writing of a register are performed by the scanner controller 4302.

(2) Reference numeral 4303 denotes a printer controller, which is connected to the printer by the video I/F and controls operations of the printer and data transfer. The printer controller 4303 is connected to a GBI 4301B by an IF bus. Data transfer and reading/writing of a register are performed by the printer controller 4303.

(3) The G bus/B bus I/F units (GBIs) 4301A and 4301B are a units for connecting the scanner controller 4302 and the printer controller 4303 to the G bus or the B bus. The GBIs 4301A and 4301B are independently connected to the scanner controller 4302 and the printer controller 4303, respectively, and connected to both of the G bus and the B bus.

Further, a CP bus is a bus for directly connecting image data of the scanner and the printer and a synchronizing signal for horizontal and vertical synchronization.

Description of the Power Management Unit

The main controller 111 is a large scale ASIC incorporating a CPU. Therefore, when all logics inside it operate simultaneously, a large amount of heat is generated and a chip itself is likely to be destroyed. In order to prevent this, the main controller 111 manages power for each block , that is, it performs power management, and further watches an amount of power consumption of the entire chip.

The power management is performed individually by each block. Information on the amount of power consumption in each block is collected in the power management unit (PMU) 409 shown in FIG. 4 as a power management level. The PMU 409 totals the amount of power consumption in each block and collectively monitors the amount of power consumption in each block of the main controller 111 such that the value of the total amount of power consumption does not exceed a limit power consumption.

As described above, the image forming apparatus of the present invention is provided with the both side image forming mechanism that does not use a tray exclusively used for sheets to be printed on both sides. Moreover, the image forming apparatus of the present invention is an image forming apparatus such as a copying machine and a printer employing a digital image processing process, and can efficiently control an image inputting device and an image outputting device.

A method of transporting a recording sheet in a case in which one side image formation is performed will be hereinafter described with reference to FIGS. 7A to 7C.

Figure 7A:
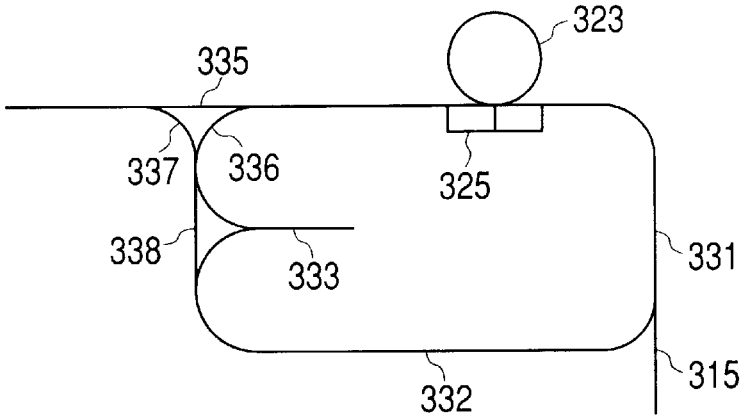
FIGS. 7A, 7B and 7C are schematic illustrations showing states of transporting a recording sheet in a case in which one side image formation is performed in the printer unit shown in FIG. 2.
Figure 7B:
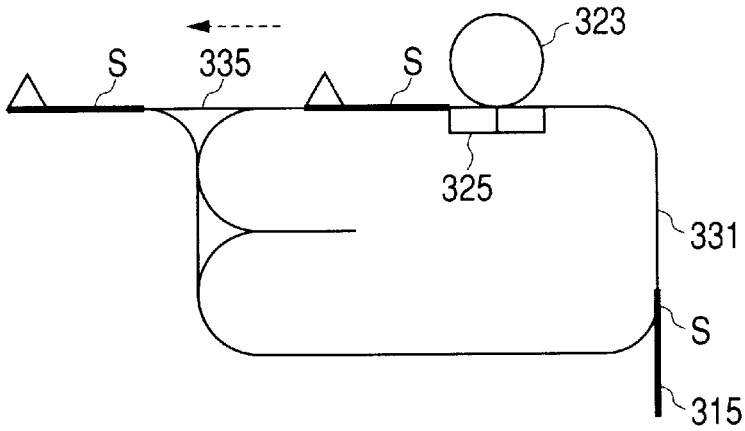
Figure 7C:
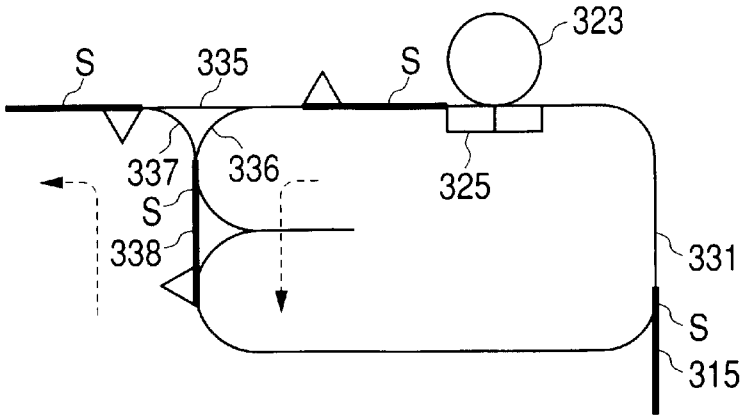

FIGS. 7A to 7C are schematic illustrations showing states of transporting a recording sheet in a case in which one side image formation is performed in the printer unit 300 shown in FIG. 2, in which parts identical with those in FIG. 2 are denoted by the identical reference numerals. Further, description will be hereinafter made by limiting a sheet feeding shelf to the hand supply sheet feeding shelf 315. However, the description is similarly applied to the cassettes 311, 312, 313 and 314 as well.

In the figures, FIG. 7A corresponds to a state in which a recording sheet is not transported on a transporting path, and FIGS. 7B and 7C correspond to a method of transporting a recording sheet on which one side image formation is performed.

In a case in which one side image formation is performed, a recording sheet S, on which one side image formation is to be performed, fed from the hand supply sheet feeding means 315 passes the sheet transporting path 331 to be transported to the transfer portion 325 as shown in FIG. 7B. The recording sheet S on which an image has been transferred (in the figure Δ indicates a transferred image) passes the transporting path 335 and is discharged. In this case, the transferred image is discharged facing upward.

Alternatively, if it is desired to discharge a transferred image facing downward, a recording sheet S on which an image has been transferred in the transfer portion 325 (in the figure Δ indicates a transferred image) passes the transporting path 336 and a transporting path 338, from where the recording sheet S is transported in the opposite direction and passes a transporting path 327 to be discharged, as shown in FIG. 7C. In this way, the recording sheet S for one side image formation is switched back, whereby it becomes possible to discharge a transferred image facing downward.

A method of transporting a recording sheet in a case in which both side image formation is performed will be hereinafter described with reference to FIGS. 8A and 8B.

Figure 8A:
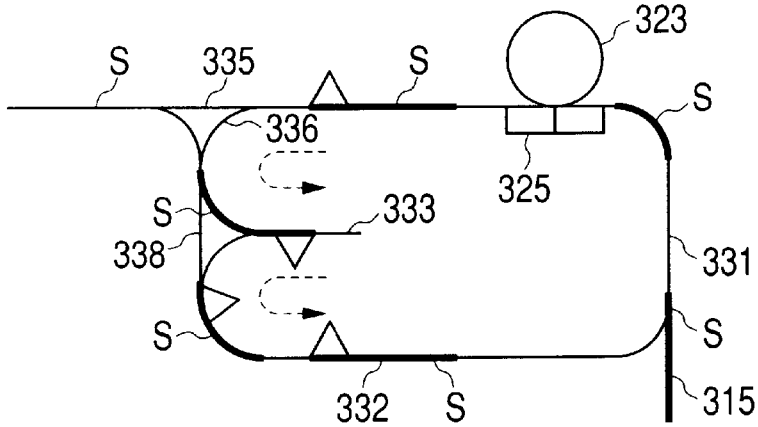
FIGS. 8A and 8B are schematic illustrations showing states of transporting a recording sheet in a case in which both side image formation is performed in the printer unit shown in FIG. 2.
Figure 8B:
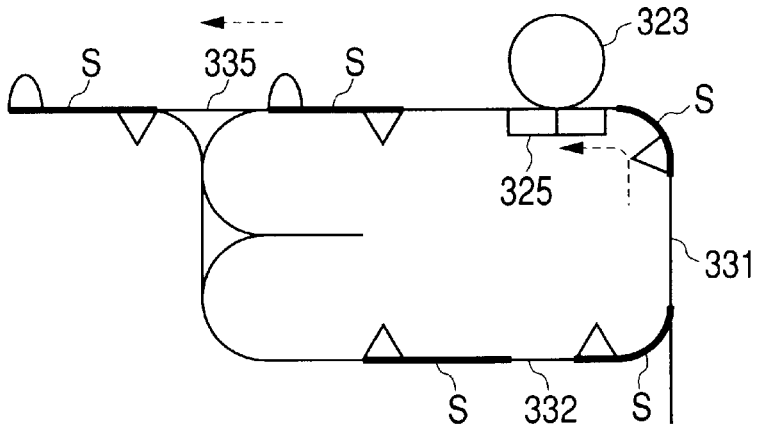

FIGS. 8A and 8B are schematic illustration showing states of transporting a recording sheet in a case in which both side image formation is performed in the printer unit 300 shown in FIG. 2, in which parts identical with those of FIG. 2 are denoted by the identical reference numerals. Further, description will be hereinafter made by limiting a sheet feeding shelf to the hand supply sheet feeding shelf 315. However, the description is similarly applied to the cassettes 311, 312, 313 and 314 as well.

First, in a case in which an image is formed on a front side of a recording sheet on which the both side image formation is performed, a sheet S, on which the both side image formation is performed, fed from the hand supply sheet feeding means 315 passes the sheet transporting path 331 and is transported to the transfer portion 325 as shown in FIG. 8A. The recording sheet S on which an image has been transferred (in the figure Δ indicates a transferred front side image) is guided from the transporting path 336 to the transporting path 333, the recording sheet S is thereafter transported in the opposite direction and guided to the transporting path 338 and the re-fed sheet transporting path 332.

Then, as shown in FIG. 8B, the recording sheet S for the both side image formation on a front side of which an image has transferred and existing in the re-fed sheet transporting path 332 (in the figure Δ indicates a transferred front side image) is thereafter re-fed to the transporting path 331 and transported to the transfer portion 325 at a suitable timing as shown in FIG. 8B. The recording sheet S for the both side image formation on a back side of which an image has been transferred (in the figure Δ indicates a transferred front side image, and a half ellipse in the figure indicates a backside image) passes the transporting path 335 and discharged to the outside of the apparatus.

Figure 9A:
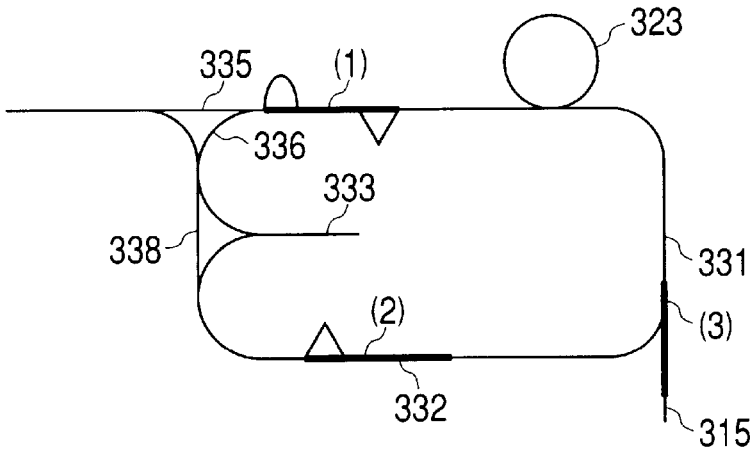
FIGS. 9A and 9B are schematic illustrations showing states of transporting a recording sheet in a case in which circulating both side image formation is performed in the printer unit shown in FIG. 2.
Figure 9B:
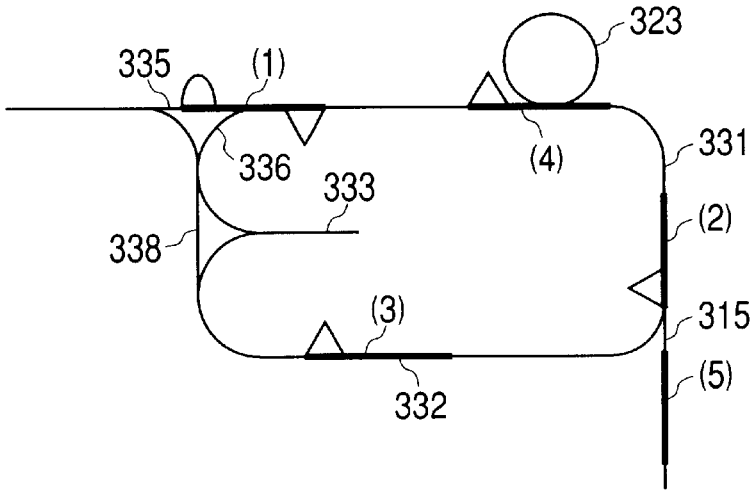

A method of transporting a recording sheet in a case in which the circulating both side image formation is performed with reference to FIGS. 9A and 9B.

FIGS. 9A and 9B are schematic illustrations showing states of transporting a recording sheet in a case in which the circulating both side image formation is performed in the printer unit 300 shown in FIG. 2, in which parts identical with those in FIG. 2 are denoted by the identical reference numerals. Further, description will be hereinafter made by limiting a sheet feeding shelf to the hand supply sheet feeding shelf 315. However, the description is similarly applied to the cassettes 311, 312, 313 and 314 as well.

In the figures, FIG. 9A indicates an order for transporting recording sheets existing on a sheet transporting path in the case of three sheets circulation. (1) to (3) in the indicate orders of transporting the recording sheets existing on the sheet transporting path.

FIG. 9B indicates an order of transporting recording sheets existing on a sheet transporting path in the case of five sheets circulation. (1) to (5) in the figure indicate orders of transporting the recording sheets existing on the sheet transporting path.

Figures 10A, 10B:
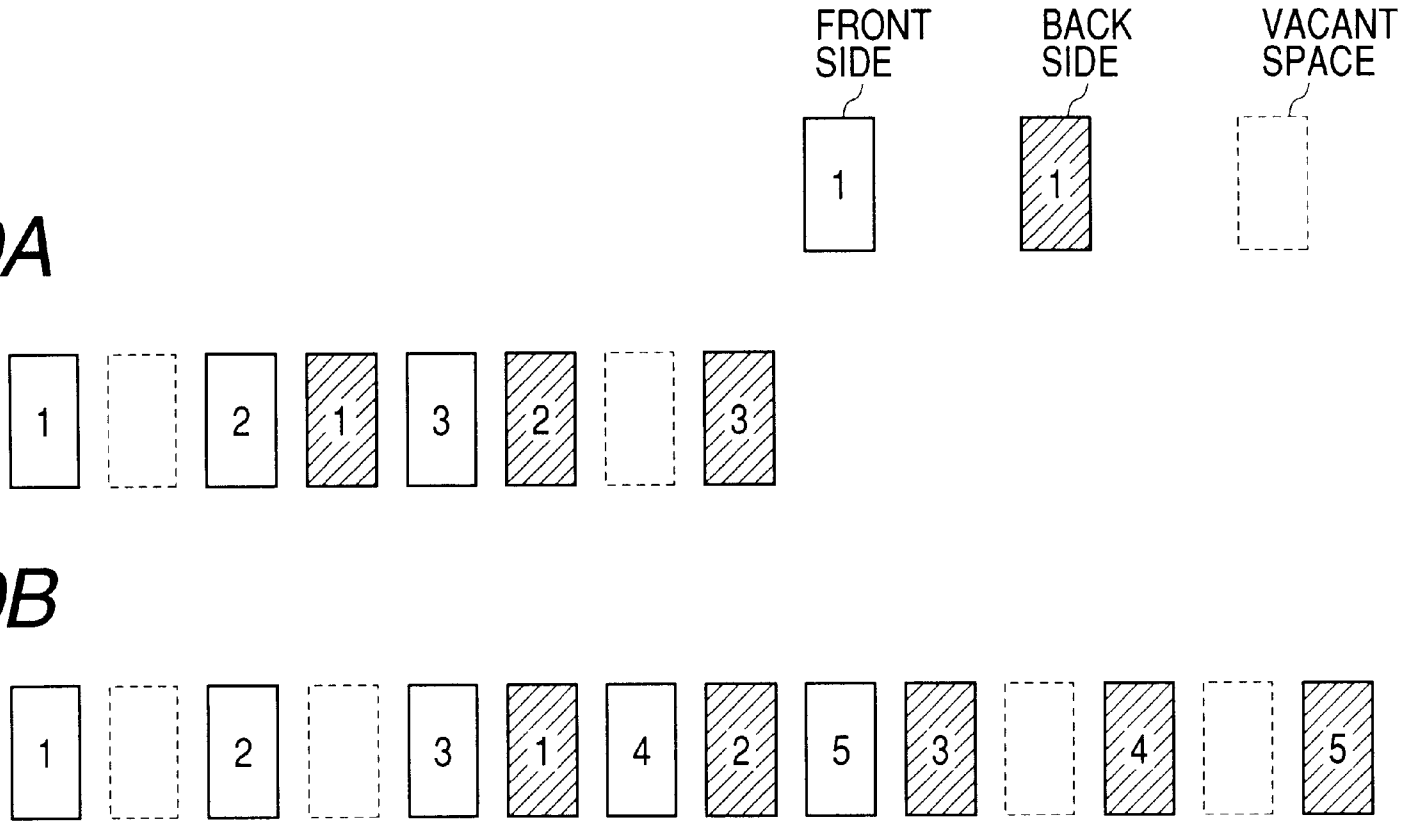
FIGS. 10A and 10B are schematic illustrations showing an order of feeding sheets at the time of circulating image formation in the image forming apparatus of the present invention.

FIGS. 10A and 10B are schematic illustrations showing orders of feeding sheets at the time of the circulating image formation in the image forming apparatus of the present invention.

In the figures, FIG. 10A indicates an order of feeding sheets in the case of three sheet circulation, and FIG. 10B indicates an order of feeding sheets in the case of five sheets circulation.

Further, a frame of solid lines not hatched indicates feeding of a front side of a recording sheet in the both side image formation or feeding of a recording sheet in the one side image formation.

In addition, a hatched frame of solid lines indicates re-feeding of a back side of a recording sheet in the both side image formation. Further, a frame of broken lines indicates that there is a space equivalent to one sheet between sheets.

In addition, in the figure, numerals 1 to 5 written on recording sheets indicate how many sheets have been fed.

As shown in FIG. 10A, in a case in which the three sheets circulating type image formation is performed in the both side image formation, after feeding the front side of the first sheet, the front side of the second sheet is fed next rather than re-feeding the back side of the first sheet. Then, the back side of the first sheet that was fed earlier is re-fed and the front side of the third sheet is fed thereafter. Thus, re-feeding of the back side and feeding of the front side are alternately continued.

As shown in FIG. 10B, in a case in which the five sheets circulating type image formation is performed in the both side image formation, the front side of the second sheet is fed rather than re-feeding the back side of the first sheet after feeding the front side of the first sheet. Moreover, the front side of the third sheet is fed rather than re-feeding the back side of the first sheet as in the three sheets circulation. Then, the back side of the first sheet that was fed earlier is re-fed and the front side of the fourth sheet is fed thereafter. Thus, re-feeding of the back side and feeding of the front side are alternately continued.

In this way, the number of circulating sheets is changed to three or five in order to efficiently perform the both side image formation of sheets with different sizes.

Figures 11A, 11B, 11C:
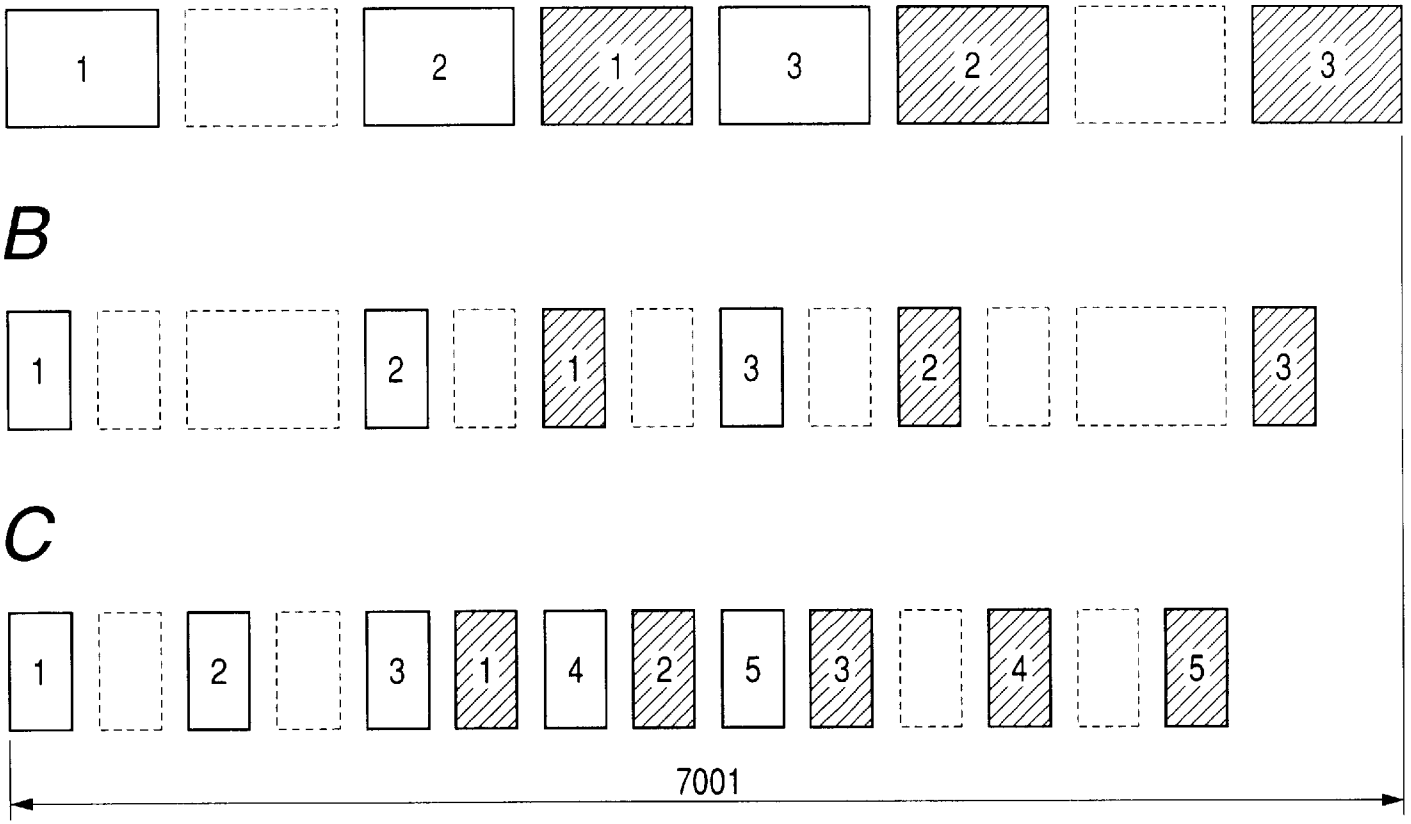
FIGS. 11A, 11B and 11C are schematic illustrations showing timings for feeding sheets according to different numbers of circulating sheets in an identical path length in an image forming apparatus of this type.

FIGS. 11A to 11C are schematic illustrations showing timings for feeding sheets according to different numbers of circulating sheets in an identical path length in an image forming apparatus of this type.

Further, a frame of solid lines not hatched indicates feeding of a front side of a recording sheet in the both side image formation or feeding of a recording sheet in the one side image formation.

In addition, a hatched frame of solid lines indicates re-feeding of a back side of a recording sheet in the both side image formation. Moreover, a frame broken lines indicates that there is a space equivalent to one sheet between sheets.

In addition, in the figure, numerals 1 to 5 written on recording sheets indicate how many sheets have been fed for each size.

In the figures, FIG. 11A corresponds to three sheets circulation of a large sheet size, FIG. 11B corresponds to a three sheets circulation of a small sheet size (a paper size, a sheet size and a recording medium size are used to indicate the same meaning), and FIG. 11C corresponds to a five sheets circulation of a small sheet size.

As shown in the figure, in a case in which a length of sheet path 7001 is fixed, if three sheets circulating type image formation is performed in the case of sheets of a large size as shown in FIG. 11A, images can be formed efficiently with only a few spaces between sheets. However, in the case of sheets of a small size with the identical sheet path length 7001 as shown in FIG. 11B, if the three sheets circulating type image formation is performed, there are many spaces between sheets and an image cannot be formed efficiently.

Therefore, the five sheets circulating type image formation is performed for a small sheet size as shown in FIG. 11C, whereby an image can be formed efficiently without leaving many spaces between sheets.

Thus, the number of circulating sheets is made variable according to a sheet size, whereby an image can be formed efficiently. That is, when a sheet is small, the five sheets circulating type image formation is performed, and when a sheet is large, the three sheets circulating type image formation is performed.

A case will now be described with reference to FIGS. 12A, 12B, 13A and 13B, in which the both side image formation of different sheet sizes is performed in the image forming apparatus of the present invention, and the image formation is shifted from the three sheets circulating type image formation to the five sheets circulating type image formation or from the five sheets circulating type image formation to the three sheets circulating type image formation.

FIGS. 12A, 12B, 13A and 13B are schematic illustration showing orders of feeding sheets when different modes of circulating image formation coexist in the image forming apparatus of the present invention.

Further, a frame of solid lines not hatched indicates feeding of a front side of a recording sheet in the both side image formation or feeding of a recording sheet in the one side image formation.

In addition, a hatched frame of solid lines indicates re-feeding of a back side of a recording sheet in the both side image formation. A frame of broken lines indicates that there is a space equivalent to one sheet between sheets. Numerals in parenthesis (4) to (8) written on recording sheets indicate how many sheets have been fed in total.

In addition, in the figure, numerals 1 to 5 written on recording sheets indicate how many sheets have been fed.

Figure 12A:
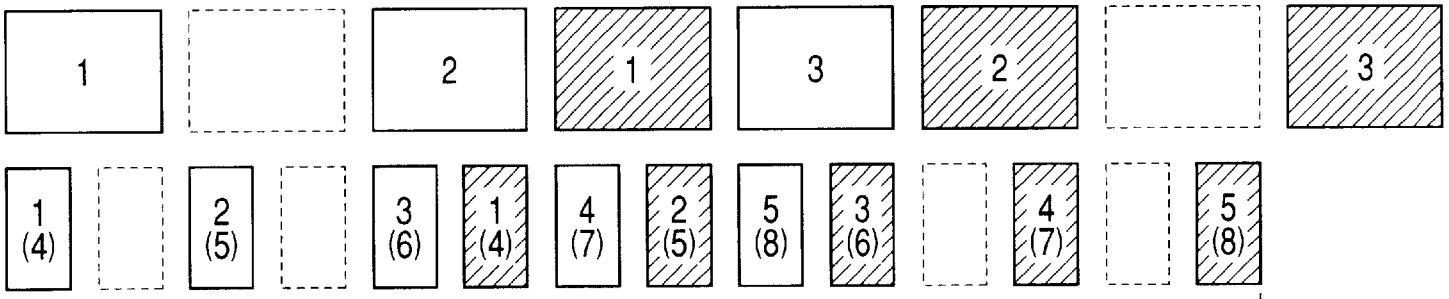
FIGS. 12A and 12B are schematic illustrations showing an order of feeding sheets when different types of circulating image formation coexist in the image forming apparatus of the present invention.

As shown in FIG. 12A, the both side image formation of three large size sheets is performed and then that of five small size sheets is performed, that is, the image formation is shifted in the middle of the three sheets circulating type image formation to the five sheets circulating type image formation, the three sheets circulating type image formation is discontinued once, and then the image formation is shifted to the five sheets circulating type image formation for the five small sheets in a conventional control.

Figure 12B:
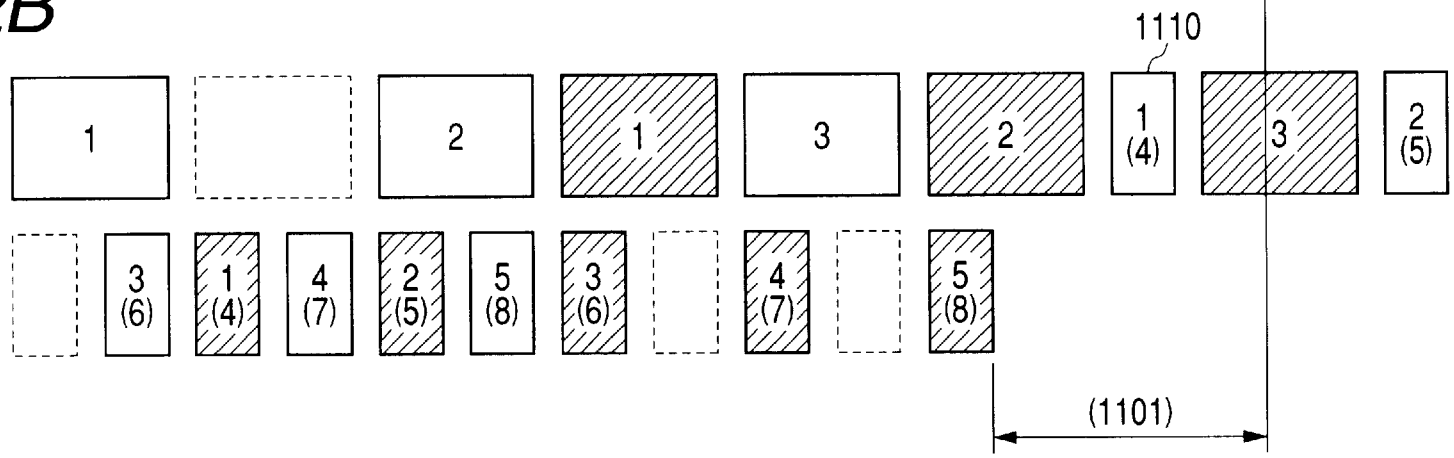

However, as shown in FIG. 12B, the front side of the fourth sheet (the first one of small size sheets) is fed at a timing of 1110 between re-feeding of the back side of the second sheet and re-feeding of the back side of the third sheet. Thus, even if the three sheets circulating type image formation is not discontinued, the image formation can be shifted from the three sheets circulating type image formation to the five sheets circulating type image formation without interruption.

With such a control, a time required for image formation can be reduced as shown by 1101 in the figure.

Figure 13A:
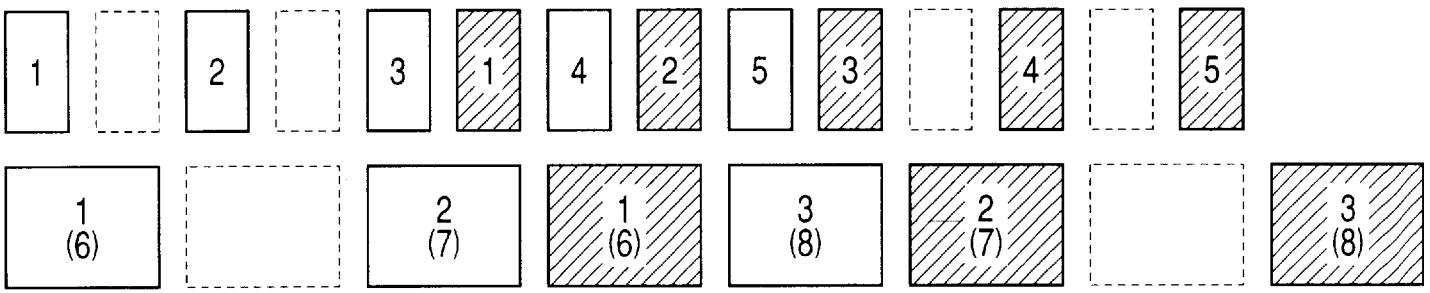
FIGS. 13A and 13B are schematic illustrations showing an order of feeding sheets when different types of circulating image formation coexist in the image forming apparatus of the present invention.

In addition, as shown in FIG. 13A, the both side image formation of five small size sheets is performed and then that of three large size sheets is performed, that is, the image formation is shifted in the middle of the five sheets circulating type image formation to the three sheets circulating type image formation, the five sheets circulating type image formation is discontinued once, and then the image formation is shifted to the three sheets circulating type image formation in a conventional control.

Figure 13B:
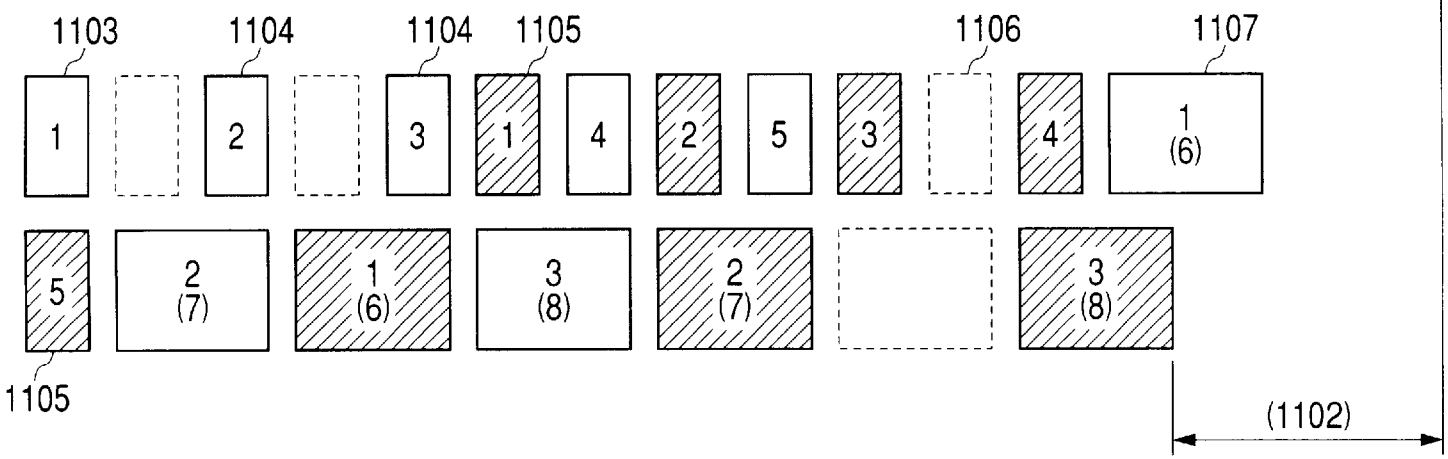

However, as shown in FIG. 13B, the front side of the sixth sheet (the first one of large size sheets) is fed at a timing of 1107 between re-feeding of the back side of the fourth sheet and re-feeding of the back side of the fifth sheet. Thus, even if the five sheets circulating type image formation is not discontinued completely, the image formation can be shifted from the five sheets circulating type image formation to the three sheets circulating type image formation without interruption. With such control, a time required for image formation can be reduced as shown by 1102 in the figure.

A control method will be hereinafter described for each timing in FIG. 13B with reference to FIG. 13B and a flow chart of FIG. 14, which performs the circulating type both side image formation of the different numbers of circulating sheets without interruption as described above in the image forming apparatus of the present invention, that is, a determination routine for determining which sheet is fed or re-fed and how for each timing of determining sheet feeding.

Figure 14:
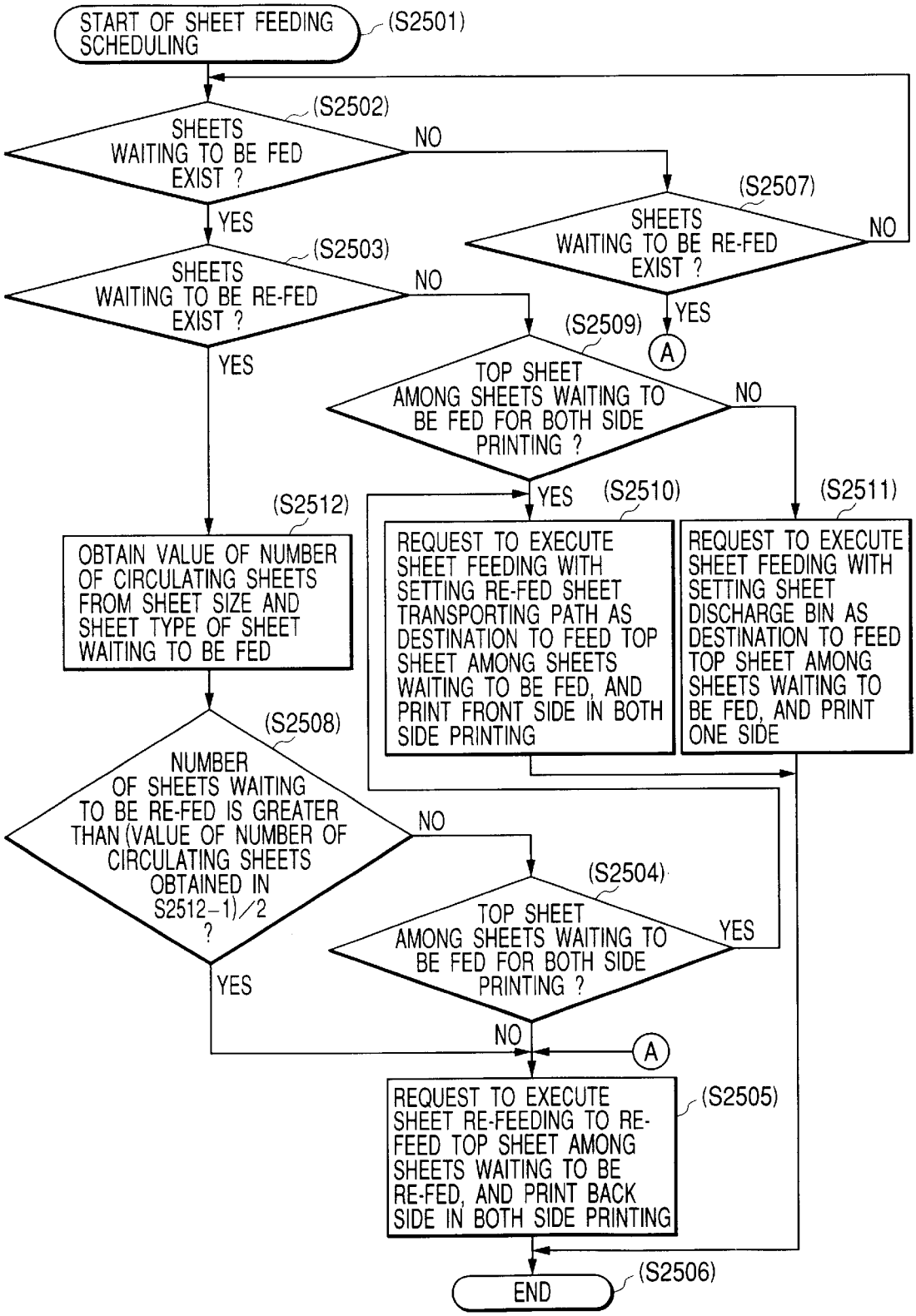
FIG. 14 is a flow chart showing an example of a first control processing procedure of the image forming apparatus of the present invention.

FIG. 14 is a flow chart showing an example of a first control processing procedure of the image forming apparatus of the present invention, which corresponds to an example of a control procedure for performing the circulating type both side image formation of different numbers of circulating sheets without interruption. Further, it is assumed that the CPU 112 shown in FIG. 3 executes this processing based on a program stored in the ROM 114 or not-shown other storage medium. In addition, S2501 to S2512 indicate each step.

Further, in this description, a small size sheet is regarded as "plain paper" of "A4" and a large size sheet is regarded as "plain paper" of "A3".

First, at a timing 1103 of FIG. 13B, sheet feed scheduling is first started in step S2501 and it is determined in step S2502 if there are sheets waiting to be fed as shown in the flow chart of FIG. 14.

Since sheets waiting to be fed exist at the timing 1103 of FIG. 13B, the processing advances to step S2503.

Then, in step S2503, it is determined whether there are sheets waiting to be re-fed. Since sheets waiting to be re-fed do not exist at the timing 1103 of FIG. 13B, the processing advances to step S2509.

In step S2509, it is determined whether a top sheet among the sheets waiting to be fed is a sheet for both side printing. Since the sheet waiting to be fed is a sheet for the both side image formation, the processing advances to step S2510.

Then, in step S2510, a request to execute sheet feeding with setting a re-fed sheet transporting path as a sheet discharging destination is issued to feed the top sheet among the sheets waiting to be fed and the sheet feeding is executed. That is, front side printing in both side printing is performed, and the processing ends (S2506).

At a timing 1104 of FIG. 13B, sheet feed scheduling is first started in step S2501 as shown in the flow chart of FIG. 14. In step S2502, it is determined whether there are sheets waiting to be fed. Since sheets waiting to be fed exist, the processing advances to step S2503.

In step S2503, it is determined whether there are sheets waiting to be re-fed. Since sheets waiting to be re-fed exist (in the case of feeding the second sheet, the first sheet is waiting to be re-fed, and in the case of feeding the third sheet, the first and the second sheets are waiting to be re-fed), the processing advances to step S2512.

In step S2512, a value of the number of circulating sheets is calculated from a sheet size and a paper type of the sheets waiting to be fed (based on a table of the number of circulating sheets corresponding to a sheet size and a paper type shown in FIG. 15 to be described later). Since the sheets waiting to be fed at the timing 1104 are sheets of the small sheet size and the paper type is the plain paper, the number of circulating sheets can be determined as "5." The value (the number of circulating sheets) is stored, and the processing advances to step S2508.

In step S2508, it is determined whether the number of sheets waiting to be re-fed is larger than "(the value of the number of circulating sheets calculated in step S2512-1)/2." Here, the value of the number of circulating sheets calculated in step S2512 is "5." Thus, since "(5−1)/2=2," this "2" and the number of sheets waiting to be re-fed are compared. The number of sheets waiting to be re-fed is "1" in the case of feeding the second sheet and "2" in the case of feeding the third sheet. Since both values are not larger than "2," the processing advances to step S2504.

In step S2504, it is determined whether a top sheet among the sheets waiting to be fed is a sheet for both side printing. Since the top sheet among the sheets waiting to be fed is for both side printing here, the processing advances to step S2510.

Then, in step S2510, a request to execute sheet feeding with setting a re-fed sheet transporting path as a sheet discharging destination is issued to feed the top sheet among the sheets waiting to be fed and the sheet feeding is executed. That is, front side printing in both side printing is performed, and the processing ends (S2506).

Next, at a timing 1105 of FIG. 13B, sheet feed scheduling is first started in step S2501 as shown in the flow chart of FIG. 14. In step S2502, it is determined whether there are sheets waiting to be fed. Since sheets waiting to be fed exists, the processing advances to step S2503.

In step S2503, it is determined whether there are sheets waiting to be re-fed. Since sheets waiting to be re-fed exist (in the case of re-feeding the first sheet, the first, the second and the third sheets are waiting to be re-fed and, on the other hand, in the case of re-feeding the fifth sheet, the fifth and the sixth sheets (the first sheet of the large size sheet) are waiting to be re-fed), the processing advances to step S2512.

In step S2512, a value of the number of circulating sheets is calculated from a sheet size and a paper type of the sheets waiting to be fed (based on a table of the number of circulating sheets corresponding to a sheet size and a paper type shown in FIG. 15 to be described later).

First, in the case of re-feeding the first sheet at the timing 1105, since the sheets waiting to be fed are sheets of the small sheet size and the paper type is the plain paper, the number of circulating sheets can be determined as "5." The value (the number of circulating sheets "5") is stored, and the processing advances to step S2508.

In step S2508, it is determined whether the number of sheets waiting to be re-fed is larger than "(the value of the number of circulating sheets calculated in step S2512-1)/2." Here, the value of the number of circulating sheets calculated in step S2512 is "5." Thus, since "(5−1)/2=2," this "2" and the number of sheets waiting to be re-fed are compared. The number of sheets waiting to be re-fed is "3" in the case of re-feeding the first sheet at the timing 1105 because the three sheets of the first, the second and the third sheets are waiting to be re-fed. Since the value is larger than "2," the processing advances to step S2505.

Then, in step S2505, a request to execute re-feeding of the top sheet among the sheets waiting to be re-fed is issued and re-feeding is performed. That is, the back side printing in both side printing is performed and the processing ends (S2506).

On the other hand, in the case of re-feeding the fifth sheet at the timing 1105, since the sheets waiting to be fed are sheets of the large size and the paper type is the plain paper, the number of circulating sheets can be determined as "3." The value (the number of circulating sheets "3") is stored, and the processing advances to step S2508.

In step S2508, it is determined whether the number of sheets waiting to be re-fed is larger than "(the value of the number of circulating sheets calculated in step S2512-1)/2." Here, the value of the number of circulating sheets calculated in step S2512 is "3." Thus, since "(3−1)/2=1," this "1" and the number of sheets waiting to be re-fed are compared. The number of sheets waiting to be re-fed is "3" in the case of re-feeding the fifth sheet at the timing 1105 because the two sheets of the fifth and the sixth sheets (the first sheet of the large size sheet) are waiting to be re-fed. Since the value is larger than "1," the processing advances to step S2505.

Then, in step S2505, a request to execute re-feeding of the top sheet among the sheets waiting to be re-fed is issued and re-feeding is performed. That is, the back side printing in both side printing is performed and the processing ends (S2506).

Then, at a timing 1106 of FIG. 13B, sheet feed scheduling is first started in step S2501 and it is determined in step S2502 if there are sheets waiting to be fed as shown in the flow chart of FIG. 14. Since sheets waiting to be fed exist, the processing advances to step S2503.

In step S2503, it is determined whether there are sheets waiting to be re-fed. Since sheets waiting to be re-fed exist (the fourth and the fifth sheets are waiting to be re-fed), the processing advances to step S2512.

In step S2512, a value of the number of circulating sheets is calculated from a sheet size and a paper type of the sheets waiting to be fed (based on a table of the number of circulating sheets corresponding to a sheet size and a paper type shown in FIG. 15 to be described later). Since the sheets waiting to be fed at the timing 1106 are sheets of the large sheet size and the paper type is the plain paper, the number of circulating sheets can be determined as "3." The value (the number of circulating sheets "3") is stored, and the processing advances to step S2508.

In step S2508, it is determined whether the number of sheets waiting to be re-fed is larger than "(the value of the number of circulating sheets calculated in step S2512-1)/2." Here, the value of the number of circulating sheets calculated in step S2512 is "3." Thus, since "(3−1)/2=1," this "1" and the number of sheets waiting to be re-fed are compared. The number of sheets waiting to be re-fed is "2" because two sheets of the fourth and the fifth sheets are waiting to be re-fed at the timing 1106. Since the value is larger than "1," the processing advances to step S2505.

Then, in step S2505, a request to execute re-feeding of the top sheet among the sheets waiting to be re-fed is issued and re-feeding is performed. That is, the back side printing in both side printing is performed and the processing ends (S2506).

Then, at a timing 1107 of FIG. 13B, sheet feed scheduling is first started in step S2501 and it is determined in step S2502 if there are sheets waiting to be fed as shown in the flow chart of FIG. 14. Since sheets waiting to be fed exist, the processing advances to step S2503.

In step S2503, it is determined whether there are sheets waiting to be re-fed. Since sheets waiting to be re-fed exist (the fifth sheet is waiting to be re-fed), the processing advances to step S2512.

In step S2512, a value of the number of circulating sheets is calculated from a sheet size and a paper type of the sheets waiting to be fed (based on a table of the number of circulating sheets corresponding to a sheet size and a paper type shown in FIG. 15 to be described later). Since the sheets waiting to be fed at the timing 1107 are sheets of the large sheet size and the paper type is the plain paper, the number of circulating sheets can be determined as "3." The value (the number of circulating sheets "3") is stored, and the processing advances to step S2508.

In step S2508, it is determined whether the number of sheets waiting to be re-fed is larger than "(the value of the number of circulating sheets calculated in step S2512-1)/2." Here, the value of the number of circulating sheets calculated in step S2512 is "3." Since "(3−1)/2=1," the number of sheets waiting to be re-fed is "1." The number of sheets waiting to be re-fed at the timing 1106 is "1" because one sheet, that is, the fifth sheet is waiting to be re-fed, which is not larger than "1" being the result of the calculation of "(the value of the number of circulating sheets calculated in step S2512-1)/2." Thus, the processing advances to step S2504.

In step S2504, it is determined whether a top sheet among the sheets waiting to be fed is a sheet for both side printing. Since the top sheet among the sheets waiting to be fed is for both side printing here, the processing advances to step S2510.

Then, in step S2510, a request to execute sheet feeding with setting a re-fed sheet transporting path as a sheet discharging destination is issued to feed the top sheet among the sheets waiting to be fed the sheet feeding is executed, and the processing ends (S2506).

Cases other than the timings 1103 to 1107 of FIG. 13B will be hereinafter described.

If it is determined in step S2502 that there is no sheet waiting to be fed, the processing advances to step S2507, where it is determined whether there are sheets waiting to be re-fed. If it is determined in step S2507 that there are sheets waiting to be re-fed, the processing advances to step S2505. In step S2505, a request to execute re-feeding of the top sheet among the sheets waiting to be re-fed is issued and re-feeding is performed. That is, the back side printing in both side printing is performed and the processing ends (S2506).

On the other hand, if it is determined in step S2507 that there is no sheet waiting to be re-fed, the processing returns to step S2501 and waits for the sheet feeding schedule to be started.

In addition, if it is determined in step S2509 that the top sheet among the sheets waiting to be fed is not for the both side printing, the processing advances to step S2511.

Then, in step S2511, a request to execute sheet feeding with setting a discharge bin as a destination is issued to feed the top sheet among the sheets waiting to be fed, the sheet feeding is executed, and the processing ends (S2506).

Moreover, if it is determined in step S2504 that the top sheet among the sheets waiting to be fed is not for the both side printing, the processing advances to step S2505. Then, in step S2505, a request to execute sheet re-feeding is issued to re-feed the top sheet among the sheets waiting to be re-fed, and the sheet re-feeding is executed. That is, the back side printing in both side printing is performed, and the processing ends (step S2506).

As described above in the flow chart of FIG. 14, the number of circulating sheets is obtained from a sheet size and a paper type (sheet type). Then, the image forming apparatus is controlled such that, in the state in which sheets for the both side image formation waiting to be re-fed and sheets for the both side image formation waiting to be fed exist, if the number of sheets waiting to be re-fed is larger than "(the value of the number of circulating sheets calculated from the sheet size of the sheets waiting to be fed-1)/2," the re-feeding of the sheets waiting to be re-fed is performed, and if the number of sheets waiting to be re-fed is "(the value of the number of circulating sheets calculated from the sheet size of the sheets waiting to be fed-1)/2" or less, the sheet feeding of the sheets waiting to be fed is performed. Thus, even if the both side image formation of different numbers of circulating sheets is performed, the image formation can be shifted to the circulating type image formation of different numbers of circulating sheets without interrupting the circulating type image formation. Therefore, it becomes possible to complete printing within a period of time shorter than that required before.

Therefore, in the image forming apparatus provided with the both side image forming method by the circulating type sheet transporting process, a user interface capable of setting a paper type is provided, and the both side image formation in which the number of circulating sheets is made variable according to not only a sheet size but also a paper type. Thus, it is possible to perform transportation control according to a paper type of a sheet on which an image is performed to thereby prevent sheet curl and a jam due to the curl from occurring in the both side image forming method by the circulating type sheet transporting process.

FIG. 15 shows an example of a table for determining the number of circulating sheets according to a sheet size and a paper type (a table of the number of circulating sheets corresponding to a sheet size and a paper type) in the image forming apparatus of the present invention. The table is stored in the ROM 114 or the nonvolatile memory 999 shown in FIG. 3 or not-shown other storage medium.

In addition, the table may be set from the operating unit 150 shown in FIG. 1 and stored in the nonvolatile memory 999.

Although the number of circulating sheets is basically determined according to a sheet size, the number of circulating sheets may change according to a paper type for sheets such as A4R in the case of which the number of circulating sheets is 5 and a space between sheets is short. This is because a transporting speed cannot be properly controlled due to insufficient torque of a transporting motor, whereby a possibility that sheets collide with each other and a jam occurs becomes high.

For example, as shown in the figure, the number of circulating sheets is "5" for a sheet with the sheet size of "A4R" and the paper type (sheet type) of "plain paper" or "recycled paper." However, it is necessary to reduce the number of circulating sheets to 3 for a sheet with the same sheet size of "A4R" if the paper type (sheet type) is "cardboard." In addition, the number of circulating sheets is "x" for a sheet with the paper type of "OHP" because the both side printing of a sheet with the paper type of "OHP" is not performed.

In addition, although a value of the number of circulating sheets is calculated from a sheet size and a paper type in the above-mentioned step S2512 of FIG. 14, the value can be calculated from the table as shown in FIG. 15 (the table of the number of circulating sheets corresponding to a sheet size and a paper type).

In the table of the number of circulating sheets corresponding to a sheet size and a paper size of FIG. 15, a main scanning direction (width) refers to a width indicated by 1401 of FIG. 16 to be described later, and a sub-scanning direction (length) refers to a length indicated by 1402 of FIG. 16 in this embodiment.

Figure 16:
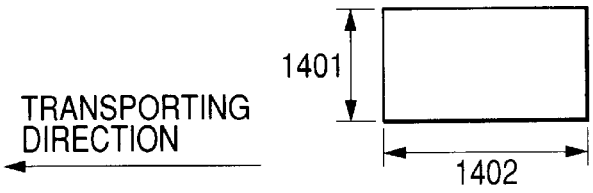
FIG. 16 is a schematic illustration showing a main scanning direction (width) and a sub-scanning direction (length) in the table of the number of circulating sheets corresponding to a sheet size and a paper type shown in FIG. 15.

FIG. 16 is a schematic illustration showing a main scanning direction (width) and a sub-scanning direction (length) in the table of the number of circulating sheets corresponding to a sheet size and a paper type shown in FIG. 15.

In the figure, reference numeral 1401 denotes a main scanning direction (width) and reference numeral 1402 denotes a sub-scanning direction (length).

Further, it is assumed that the sub-scanning direction is identical with a "transporting direction" indicated by an arrow in the figure, and the main scanning direction is the direction perpendicular to the "transporting direction."

In addition, as shown in FIG. 15, the longer the sub-scanning direction (length) the fewer the number of circulating sheets becomes (e.g., the number of circulating sheets is "3" for "A3", "A4R" (cardboard), "LEDGER" and "LETTER R" (cardboard)). The shorter the sub-scanning direction (length) the more the number of circulating sheets becomes (e.g., the number of circulating sheets is "5" for "A4" and "LETTER").

Moreover, in step S2512 of FIG. 14, the CPU 112 shown in FIG. 3 needs to derive not only a sheet size but also a paper type (sheet type). The CPU 112 needs to set which type of paper is placed in advance in each sheet feeding shelf.

Figure 17:
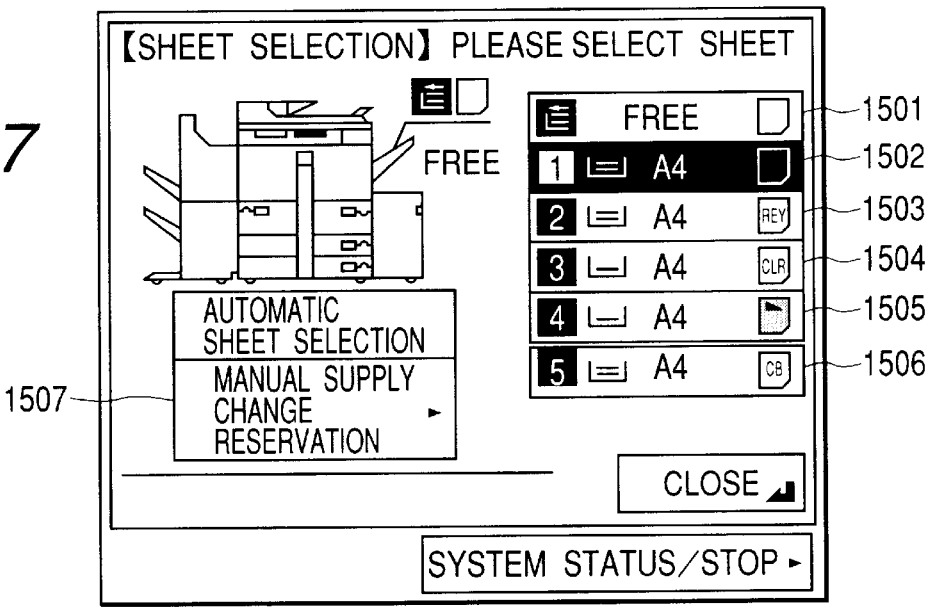
FIG. 17 is a schematic illustration of a screen for displaying paper types set for each sheet feeding shelf that is displayed on a not-shown touch panel of an operating unit shown in FIG. 1.

FIG. 17 is a schematic illustration of a screen for displaying paper types set for each sheet feeding shelf that is displayed on a not-shown touch panel of an operating unit 150 shown in FIG. 1.

As shown in the figure, the sheet type is set in such a manner as plain paper for the first tray, recycled paper for the second tray, color paper for the third tray, a letter head for the fourth tray and cardboard for the fifth tray.

In addition, these can be set by a paper type setting screen shown in FIG. 18 to be described later and can be set for a hand supply sheet feeding shelf as well.

Figure 18:
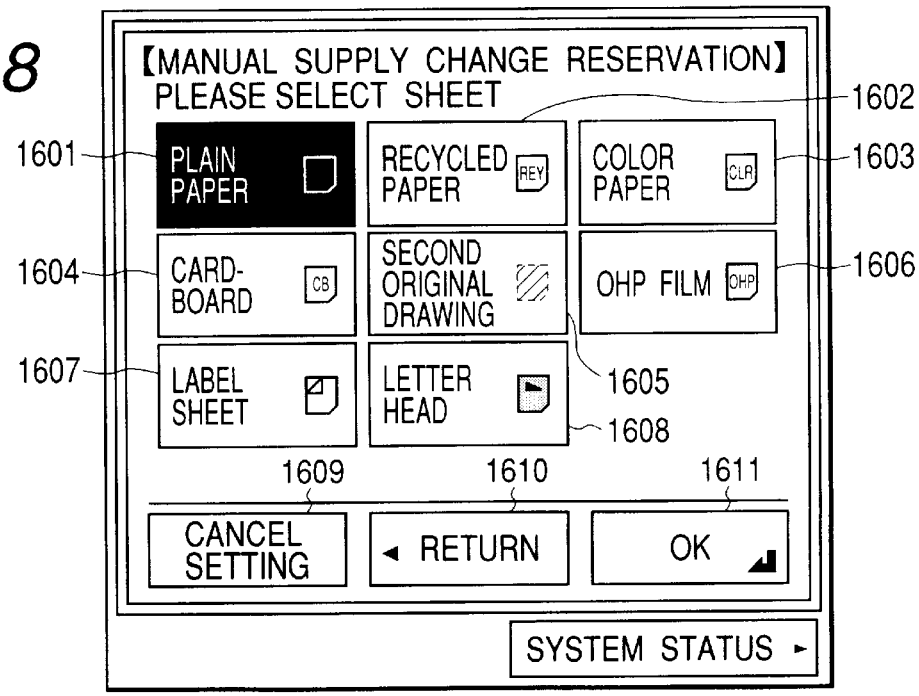
FIG. 18 is a schematic illustration of a paper type setting screen that is displayed on the not-shown touch panel of the operating unit shown in FIG. 1.
Figures 20A, 20B, 20C:
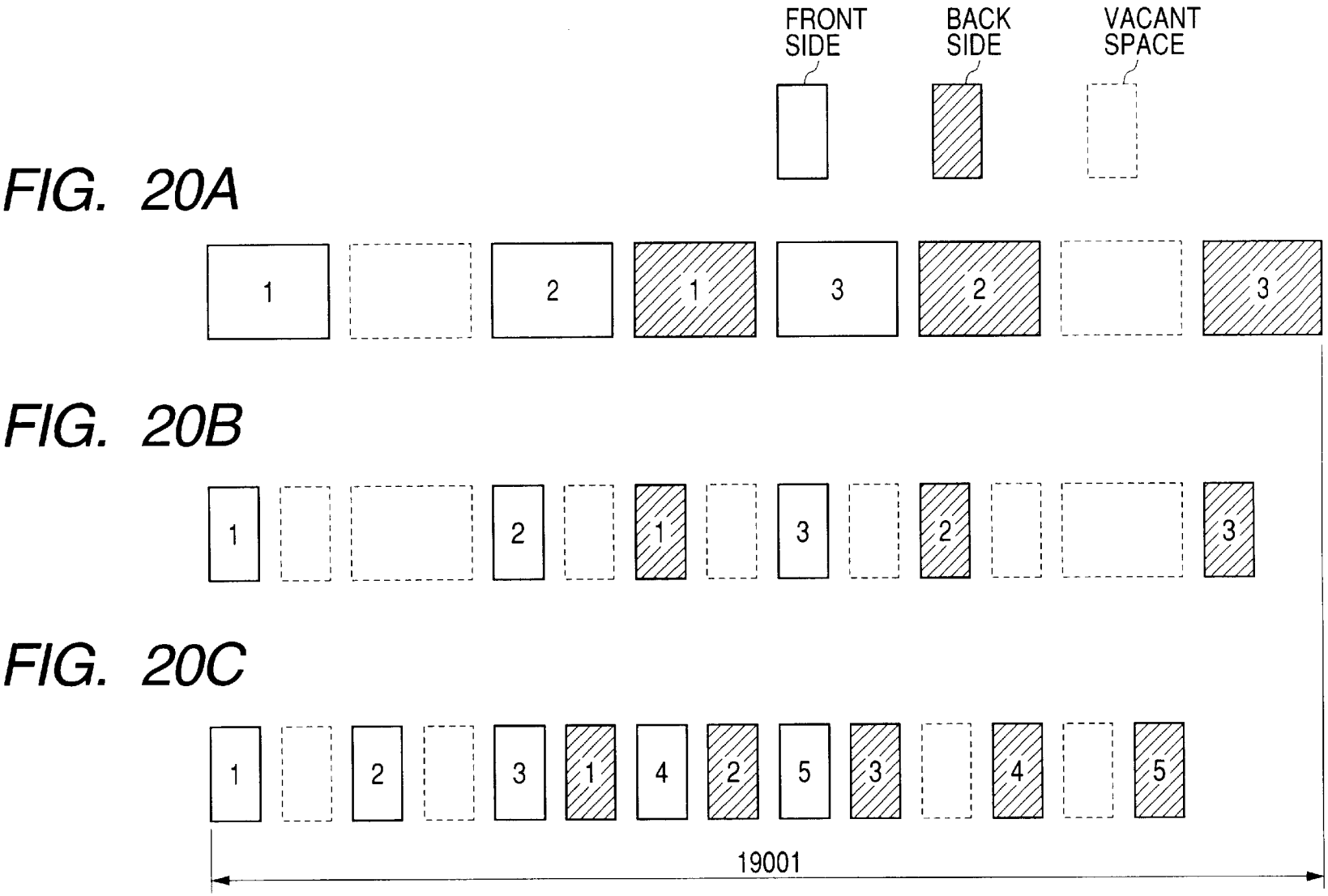
FIGS. 20A, 20B and 20C are schematic illustrations showing timings for feeding sheets according to different numbers of circulating sheets in an identical path length in an image forming apparatus of this type.

Further, the paper type setting screen shown in FIG. 18 is displayed on the not-shown touch panel of the operating unit 150 shown in FIG. 1 by selecting (depressing) sheet feeding shelf selecting keys 1502 to 1506 on the display screen (touch panel) of the paper type to press not-shown paper type selecting keys, or in the case of the hand supply sheet feeding shelf, by selecting (depressing) a hand supply sheet feeding shelf selecting key 1501 to press a hand supply change reserving key 1507.

FIG. 18 is a schematic illustration of a paper type setting screen that is displayed on the not-shown touch panel of the operating unit 150 shown in FIG. 1, which indicates a screen for setting the paper type corresponding to the hand supply sheet feeding shelf.

In the figure, reference numeral 1601 is an "plain paper" setting key, which sets the paper type of the sheet feeding shelf selected in the paper type displaying screen of FIG. 17 as "plain paper." Reference numeral 1602 is a "recycled paper" setting key, which sets the paper type of the sheet feeding shelf selected in the paper type displaying screen of FIG. 17 as "recycled paper." Reference numeral 1603 denotes a "color paper" setting key, which sets the paper type of the sheet feeding shelf selected in the paper type displaying screen of FIG. 17 as "color paper."

Reference numeral 1604 is a "cardboard" setting key, which sets the paper type of the sheet feeding shelf selected in the papery type displaying screen of FIG. 17 as "cardboard." Reference numeral 1605 denotes a "second original drawing" setting key, which sets the paper type of the sheet feeding shelf selected in the paper type displaying screen of FIG. 17 as "second original drawing." Reference numeral 1606 is an "OHP film" setting key, which sets the paper type of the sheet feeding shelf selected in the paper type displaying screen of FIG. 17 as "OHP."

Reference numeral 1607 denotes a "label sheet" setting key, which sets the paper type of the sheet feeding shelf selected in the paper type displaying screen of FIG. 17 as "label sheet." Reference numeral 1608 denotes a "letter head" setting key, which sets the paper type of the sheet feeding shelf selected in the paper type displaying screen of FIG. 17 as "letter head."

Reference numeral 1609 denotes a setting cancellation key, which cancels the paper type setting of the sheet feeding shelf selected in the paper type displaying screen of FIG. 17. Reference numeral 1610 denotes a return key, which returns the setting procedures to the paper type displaying screen of FIG. 17. Reference numeral 1611 is an OK key, which validates the setting in this paper type setting screen and stores it in the nonvolatile memory 999 shown in FIG. 3.

In this way, a sheet type is assigned to a sheet feeding shelf in advance. Thus, the CPU 112 can read which type of sheet is handled from the nonvolatile memory 999 and determine (detect) the paper type in step S2512 shown in FIG. 14 or in a not-shown step before that.

Further, a sheet size is set by a partition plate, a slide plate or a sensor provided in a cassette or a sheet feeding shelf of each sheet feeding shelf. The CPU 112 can recognize (detect) a sheet size in step S2512 shown in FIG. 14 or a not-shown step before that.

As described above, in the both side image forming method by the circulating type sheet transporting process, high productivity can be maintained by minimizing sheet supply waiting time of recording sheet transportation even if sheets with different sheet sizes coexist. In addition, transportation control corresponding to a paper type of a sheet on which an image is formed is performed, whereby it becomes possible to prevent sheet curl and a jam due to the curl from occurring.

Further, in the each above-mentioned embodiment, the present invention is described with reference to a case in which the printer unit 300 uses a laser beam process. However, the present invention is applicable to an electrophotographic process (e.g., an LED process) other than the laser beam process, a liquid crystal shutter process, an ink jet process, a heat transfer process, a sublimation process or other print processes.

A configuration of a data processing program that can be read by the image forming apparatus in accordance with the present invention will now be described with reference to a memory map shown in FIG. 19.

FIG. 19 illustrates a memory map of a storage medium storing various kinds of data processing programs that can be read by the image forming apparatus in accordance with the present invention.

Further, although not specifically illustrated, information for managing a group of programs stored in the storage medium such as version information and the name of a creator may be stored, and information dependent on an OS or the like on a program reading side such as an icon or the like for distinguishing and displaying a program may also be stored.

Moreover, data dependent upon various programs is also managed in the above-mentioned directory. In addition, if a program or data to be installed is compressed, a program or the like for decompressing the program or the data may be stored.

The function shown in FIG. 14 in this embodiment may be executed by a host computer according to a program to be installed from the outside. Then, in this case, the present invention is applied even to a case in which a group of information including the program is supplied to an output device by a storage medium such as a CD-ROM, a flash memory, an FD or the like or from an external storage medium via a network.

As described above, a storage medium having a program code of software for realizing the above-mentioned function of the embodiment recorded therein is supplied to a system or an apparatus, and a computer (or a CPU or an MPU) of the system or the apparatus reads and executes a program code stored in the storage medium. It is needless to mention that the object of the present invention is also attained in this way.

In this case, the program code itself read from the storage medium realizes a novel function of the present invention, and the storage medium storing the program code constitutes the present invention.

As the storage medium for supplying the program code, for example, a floppy disk, a hard disk, an optical disk, a magneto-optical disk, a CD-ROM, a CD-R, a DVD-ROM, a magnetic tape, a nonvolatile memory card, an ROM, an EEPROM and a silicon disk can be used.

In addition, it is needless to mention that the function of the above-mentioned embodiment is realized not only by a computer executing a read out program code but also by an OS (operating system) or the like that is running on the computer executing a part or all of the actual processing based on an instruction of the program code.

Moreover, it is needless to mention that the function of the above-mentioned embodiment is realized, after a program code read out from a storage medium is written in a memory provided in a function extending board inserted in a computer or a function extending unit connected to the computer, by actual processing, a part of or all of which is executed by a CPU or the like provided in the function extending board or the function extending unit.

In addition, the present invention may be applied to a system composed of a plurality of devices or may be applied to an apparatus consisting of one device. Further, it is needless to mention that the present invention can be applied to a case in which the present invention is achieved by supplying a program to a system or an apparatus. In this case, a storage medium having a program represented by software for achieving the present invention stored therein is read out to the system or the apparatus, whereby it becomes possible that the system or the apparatus enjoys the effect of the present invention.

Moreover, the program represented by software for achieving the present invention is downloaded and read by a communication program from a database on a network, whereby it becomes possible that the system or the apparatus enjoys the effect of the present invention.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an image forming unit for forming an image on a sheet fed from a sheet loading unit;

a re-feeding path for re-feeding to said image forming unit the sheet on which an image is formed by said image forming unit;

a discriminator for discriminating a type and a size of the sheet; and a controller for circulating sheets of a number according to the type and the size of the sheet discriminated by the discriminator in said re-feeding path.

2. An image forming apparatus according to claim 1, wherein when circulating cardboard in said re-feeding path, said controller circulates sheets of a number different from the number of sheets at the time when said controller circulates a plain paper or a recycled paper.

3. An image forming apparatus according to claim 2, wherein when circulating card board in said re-feeding path, said controller circulates sheets of a number fewer than the number of sheets at the time when said controller circulates a plain paper or a recycled paper.

4. An image forming apparatus according to claim 1, wherein when circulating cardboard of an A4R size or a letter R size in said re-feeding path, said controller circulates sheets of a number different from the number of sheets at the time when said controller circulates a plain paper or a recycled paper in said re-feeding path.

5. An image forming apparatus according to claim 4, wherein when circulating cardboard of an A4R size or a letter R size in said re-feeding path, said controller circulates sheets of the number fewer than the number of sheets at the time when said controller circulates a plain paper or a recycled paper in said re-feeding path.

6. An image forming apparatus according to claim 1, wherein said re-feeding path reverses the front and the back sides of the sheet and re-feeds the sheet to said image forming portion in order to form images on both sides of the sheet.

7. An image forming apparatus according to claim 1, further comprising a setting unit for setting a type of the sheet loaded in the sheet loading unit.

8. An image forming apparatus according to claim 1, further comprising a storage unit for storing information correlating a type of a sheet and the number of circulating sheets in said re-feeding path, wherein said control unit controls the number of sheets to be circulated in said re-feeding path based on the information stored in said storage unit.

9. A method of controlling an image forming apparatus including an image forming unit for forming an image on a sheet fed from a sheet loading unit and a re-feeding path for re-feeding to said image forming unit the sheet on which an image is formed by said image forming unit, comprising:

a step of discriminating a type and a size of the sheet; and a step of circulating sheets of a number of sheets according to the discriminated type and size of the sheet in said re-feeding path.

10. A control method according to claim 9, wherein when cardboard is circulated in said re-feeding path, sheets of a number, which is different from the number of sheets at the time when a plain paper or a recycled paper is circulated in said re-feeding path, are circulated.

11. A control method according to claim 10, wherein when cardboard is circulated in said re-feeding path, sheets of a number, which is fewer than the number of sheets at the time when a plain paper or a recycled paper is circulated in said re-feeding path, are circulated.

12. A control method according to claim 9, wherein when cardboard of an A4R size or a letter R size is circulated in said re-feeding path, sheets of a number, which is different from the number of sheets at the time when a plain paper or a recycled paper is circulated in said re-feeding path, are circulated.

13. A control method according to claim 12, wherein when cardboard of an A4R size or a letter R size is circulated in said re-feeding path, sheets of a number, which is fewer than the number of sheets at the time when a plain paper or a recycled paper is circulated in said re-feeding path, are circulated.

14. A control method according to claim 9, wherein said re-feeding path reverses the front and the back sides of the sheet and re-feeds the sheet to said image forming unit in order to form images on both sides of the sheet.

15. A control method according to claim 9, further comprising a step of setting a type of the sheet loaded in the sheet loading unit.

16. A control method according to claim 9, further comprising a step of storing information correlating a type of a sheet and a number of circulating sheets in said re-feeding path are, wherein the number of sheets to be circulated in said re-feeding path is controlled based on the stored information.

17. A machine readable storage medium having stored thereon program code for controlling an image forming apparatus including an image forming unit for forming an image on a sheet fed from a sheet loading unit and a re-feeding path for re-feeding to said image forming unit a sheet on which an image is formed by said image forming unit, said program code comprising the steps of:

for discriminating a type of the sheet; and for circulating sheets of a number according to the discriminating type of the sheet in said re-feeding path.

18. An image forming apparatus comprising:

an image forming means for forming an image on a sheet fed from a sheet loading means;

a re-feeding means for re-feeding to said image forming means, the sheet on which an image is formed by said image forming means;

a discriminating means for discriminating a type and a size of the sheet; and a control means for circulating sheets of a number according to a type and a size of the sheet discriminated by the discriminating means in said re-feeding means.

* * * * *

UNITED STATES PATENT AND TRADEMARK OFFICE

CERTIFICATE OF CORRECTION

PATENT NO. : 6,539,198 B2
DATED : March 25, 2003
INVENTOR(S) : Jun Miyajima

It is certified that error appears in the above-identified patent and that said Letters Patent is hereby corrected as shown below:

Column 2,
Line 2, “space” should read -- spaces --.

Column 3,
Line 67, “programs,that” should read -- programs that --.

Column 4,
Line 54, “the.original” should read -- the original --.

Column 5,
Line 9, “synchronous” should read -- synchronism --.

Column 8,
Lines 25 and 26, “COCEC” should read -- CODEC --.

Column 9,
Line 18, “a” should be deleted.

Column 10,
Line 60, “discharged” should read -- is discharged --.

Column 11,
Line 9, “the” should read -- the figure --.

Column 12,
Line 3, “frame” should read -- frame of --.
Line 42, “illustration” should read -- illustrations --.

Column 17,
Line 54, “medium.” should read -- media. --.

Column 19,
Line 5, “an” should read -- a --.
Line 17, “papery” should read -- paper --.
Line 60, “the each” should read -- each --.

UNITED STATES PATENT AND TRADEMARK OFFICE

CERTIFICATE OF CORRECTION

PATENT NO. : 6,539,198 B2
DATED : March 25, 2003
INVENTOR(S) : Jun Miyajima

It is certified that error appears in the above-identified patent and that said Letters Patent is hereby corrected as shown below:

Column 21,
Line 35, “card board” should read -- cardboard --.

Column 22,
Line 40, “are,” should read -- , --.
Lines 50 and 51, “for” should be deleted.

Signed and Sealed this

Seventh Day of October, 2003

JAMES E. ROGAN
*Director of the United States Patent and Trademark Office*